US007719506B2

(12) United States Patent
Nakano et al.

(10) Patent No.: US 7,719,506 B2
(45) Date of Patent: May 18, 2010

(54) DISPLAY DEVICE AND DRIVER

(76) Inventors: Taketoshi Nakano, 1794-203, Kodakushimotocho, Ise-shi (JP); Takafumi Kawaguchi, 13-16, Okadai, Takicho, Taki-gun (JP); Toshihiro Yanagi, 2-502, Rorerusquare Takanohara, 2-3-1, Sakyo, Nara-shi (JP); Keishi Nishikubo, 27161, Raporu Taki, 1141-9, Oara Gosana, Takicho, Taki-gun (JP)

( * ) Notice: Subject to any disclaimer, the term of this patent is extended or adjusted under 35 U.S.C. 154(b) by 1047 days.

(21) Appl. No.: 11/398,939

(22) Filed: Apr. 5, 2006

(65) Prior Publication Data

US 2006/0187159 A1 Aug. 24, 2006

Related U.S. Application Data

(60) Division of application No. 10/176,243, filed on Jun. 20, 2002, now Pat. No. 7,098,901, which is a continuation-in-part of application No. 09/911,780, filed on Jul. 24, 2001, now Pat. No. 7,113,180.

(30) Foreign Application Priority Data

Jul. 24, 2000 (JP) ..... 2000-223171
Apr. 11, 2001 (JP) ..... 2001-113320

(51) Int. Cl.
*G09G 3/36* (2006.01)

(52) U.S. Cl. ..... 345/89; 345/98; 345/87

(58) Field of Classification Search ..... 345/87–102, 345/204, 212
See application file for complete search history.

(56) References Cited

U.S. PATENT DOCUMENTS

| | | | | | |
|---|---|---|---|---|---|
| 4,577,234 | A | * | 3/1986 | Harlan | 348/379 |
| 5,295,790 | A | * | 3/1994 | Bossart et al. | 417/43 |
| 5,640,174 | A | * | 6/1997 | Kamei et al. | 345/89 |
| 5,675,352 | A | * | 10/1997 | Rich et al. | 345/89 |
| 5,721,563 | A | | 2/1998 | Memida | 345/98 |
| 6,025,822 | A | | 2/2000 | Motegi et al. | 345/98 |
| 6,333,214 | B1 | | 12/2001 | Kim et al. | 438/142 |
| 6,388,653 | B1 | | 5/2002 | Goto et al. | 345/98 |

(Continued)

FOREIGN PATENT DOCUMENTS

JP 06-274134 9/1994

(Continued)

OTHER PUBLICATIONS

Japanese Office Action dated May 17, 2004, with English Translation.

(Continued)

*Primary Examiner*—Nitin Patel
(74) *Attorney, Agent, or Firm*—David G. Conlin; Catherine J. Toppin; Edwards Angell Palmer Dodge LLP

(57) ABSTRACT

A display device includes a display panel including a bus line section; and at least one driver for driving the bus line section included in the display panel. Each of the at least one driver includes an amplifier for generating a non-driving signal based on an input signal, the non-driving signal not contributing to driving of the bus line section.

9 Claims, 18 Drawing Sheets

U.S. PATENT DOCUMENTS

| | | | | |
|---|---|---|---|---|
| 6,448,948 | B1 | 9/2002 | Friedman | 345/74.1 |
| 6,525,705 | B1 | 2/2003 | Ishii et al. | 345/87 |
| 6,661,402 | B1 | 12/2003 | Nitta et al. | 345/99 |
| 7,098,901 | B2 * | 8/2006 | Nakano et al. | 345/204 |

FOREIGN PATENT DOCUMENTS

| | | |
|---|---|---|
| JP | 08-171081 | 7/1996 |
| JP | 09-113876 | 5/1997 |
| JP | 10-062746 | 3/1998 |
| JP | 10-153760 | 6/1998 |
| JP | 11-015451 | 1/1999 |
| JP | 11-194713 | 7/1999 |
| JP | 11-194748 | 7/1999 |
| JP | 11-352118 | 12/1999 |
| KR | 1998-025131 | 7/1998 |

OTHER PUBLICATIONS

Korean Office Action dated Sep. 30, 2003, with English translation.

* cited by examiner

DISPLAY DEVICE AND DRIVER

This is a divisional application of copending U.S. application Ser. No. 10/176,243, which is a continuation-in-part application of copending application Ser. No. 09/911,780 filed on Jul. 24, 2001.

BACKGROUND OF THE INVENTION

1. Field of the Invention

The present invention relates to a plurality of column electrode driving circuits used in a display device such as, for example, a liquid crystal display device, and a display device including the plurality of column electrode driving circuits.

2. Description of the Related Art

A liquid crystal display device includes a pair of glass substrates and a liquid crystal layer interposed between the pair of glass substrates. FIG. 5 is a plan view illustrating a schematic structure of one of the glass substrates of a conventional liquid crystal display device. The one of the glass substrates will be referred to as a "control glass substrate". The control glass substrate is indicated with reference numeral 21. The control glass substrate 21 includes a display section 21*a*. The liquid crystal layer is interposed in a plane corresponding to the display section 21*a*. The control glass substrate 21 has a plurality of row electrodes (gate electrodes) 205 and a plurality of column electrodes (source electrodes) 206 thereon. The plurality of row electrodes 205 are parallel to each other, and the plurality of column electrodes 206 are parallel to each other. The plurality of row electrodes 205 and the plurality of column electrodes 206 are perpendicular to each other. The other glass substrate (not shown; hereinafter, referred to as a counter glass substrate) has a common electrode provided on substantially the entirety of a surface thereof, the surface being closer to the liquid crystal layer than the other surface of the counter glass substrate.

The control glass substrate 21 has a lengthy gate substrate 29 thereon along one side thereof. The control glass substrate 21 has a lengthy source substrate 25 along a side thereof, which is perpendicular to the side along which the gate substrate 29 is provided. There is a gap between the display section 21*a* and the gate substrate 29. There is a gap between the display section 21*a* and the source substrate 25. A plurality of row electrode driving circuits (gate driver ICs) 22, each for driving a plurality of row electrodes 205, are provided to straddle the gap between the gate substrate 29 and the display section 21*a*. A plurality of column electrode driving circuits (source driver ICs) 23, each for driving a plurality of column electrodes 206, are provided to straddle the gap between the source substrate 25 and the display section 21*a*.

A control substrate 31 is provided in the vicinity of the gate substrate 29 and the source substrate 25. A timing controller IC 34 is mounted on the control substrate 31.

FIG. 6 is a block diagram illustrating an internal structure of the timing controller IC 34. The timing controller IC 34 includes an input buffer 34*a* for receiving a control data signal (for example, a display data signal regarding each of RGB colors in a color image displayed by the display section 21*a*, a clock signal CK, a horizontal synchronous signal HS, a vertical synchronous signal VS, an enable signal ENAB, or the like).

The timing controller IC 34 further includes a timing control section 34*b* for outputting a column electrode driving timing signal and a row electrode driving timing signal based on the control data signal which is input to the input buffer 34*a*, a source-side output buffer 34*c* for outputting a display data signal in synchronization with the column electrode driving timing signal which is output from the timing control section 34*b*, and a gate-side output buffer 34*d* for outputting the row electrode driving timing signal which is output from the timing control section 34*b*.

The timing control section 34*b* generates a column electrode driving timing signal such as, for example, a source start pulse (SSP) or a source clock (SCK) for each column electrode driving circuit 23 based on the control data signal which is output from the input buffer 34*a*. The timing control section 34*b* outputs each column electrode driving timing signal generated by the timing control section 34*b* to the source-side output buffer 34*c*. Then, the source-side output buffer 34*c* outputs the received column electrode driving timing signal to a respective column electrode driving circuit 23 on the source substrate 25 via a line 25*a* provided on a flexible printed circuit board (FPC) 33 (FIG. 5) and on the source substrate 25.

Similarly, the timing control section 34*b* also generates a row electrode driving timing signal (or a scanning signal) such as, for example, a gate start pulse (GSP) or a gate clock (GCK) for each row electrode driving circuit 22 based on the control data signal which is output from the input buffer 34*a*. The timing control section 34*b* outputs each row electrode driving timing signal generated by the timing control section 34*b* to the gate-side output buffer 34*d*. Then, the gate-s ide output buffer 34*d* outputs the received row electrode driving timing signal to a respective row electrode driving circuit 22 on the gate substrate 29 via a line 29*a* provided on an FPC 32 (FIG. 5) and on the gate substrate 29.

As described above, the timing controller IC 34 generates a column electrode driving timing signal for driving each column electrode driving circuit 23 and a row electrode driving timing signal for driving each row electrode driving circuit 22, and outputs a display data signal to each column electrode driving circuit 23 based on the control data signal and the column electrode driving timing signal in synchronization with the column electrode driving timing signal.

In the liquid crystal display device having the above-described structure, each row electrode driving circuit 22 and each column electrode driving circuit 23 are driven based on the respective row electrode driving timing signal and the respective column electrode driving timing signal which are generated by the timing controller IC 34 provided on the control substrate 31. Therefore, the timing controller IC 34 needs to have a sufficiently large size and the control substrate 31 also needs to have a large size for mounting the timing controller IC 34 thereon.

Recently, display devices including liquid crystal display devices have increased in size and become of higher definition. This has required the bus lines on the control substrate 31 and the source substrate 25 to be longer, which increases a load capacitance of each bus line and also increases the number of the column electrode driving circuits 23 connected to each bus line. As a result, the fan-out required of the output buffers 34*c* and 34*d* in the timing controller IC 34 needs to be increased, and stricter timing setting is also required.

In order to output the column electrode driving timing signals and the row electrode driving timing signals from the timing controller IC 34 to the respective column electrode driving circuit 22 and the respective row electrode driving circuit 23, the FPC 32 for connecting the control substrate 31 and the gate substrate 29 and the FPC 33 for connecting the control substrate 31 and the source substrate 25 are required. The line 29*a* provided on the gate substrate 29 and the line 25*a* provided on the source substrate 25 are also required. These requirements have significant influences on the external appearance of the display devices including an increase in the thickness.

Since the control substrate 31 and the gate substrate 29 are connected to each other using the FPC 32 and the control substrate 31 and the source substrate 25 are connected to each other using the FPC 33, the structure of the display device is complicated and the assembly process becomes more difficult. As a result, the production cost of the display device is raised.

Japanese Laid-Open Publication No. 11-194713 discloses a display device having the following structure. A column electrode driving circuit (source driver) is provided with a timing generation circuit, and the column electrode driving circuit and a row electrode driving circuit (gate driver) are operated based on the column electrode driving timing signal and the row electrode driving timing signal which are generated by the timing generation circuit. Such a structure is simpler and prevents enlargement of the entire size of the device.

Accordingly, in the above-described display device including a plurality of column electrode driving circuits (source drivers) and a plurality of row electrode driving circuits (gate drivers), it can be considered that one of the plurality of column electrode driving circuits is provided with a timing generation circuit, so that a column electrode driving timing signal and a row electrode driving timing signal generated by the timing generation circuit is supplied to each of the plurality of column electrode driving circuits and each of the plurality of row electrode driving circuits.

FIG. 7 is a plan view of a control glass substrate 210. The control substrate 210 includes a plurality of column electrode driving circuits (source drivers). One column electrode driving circuit 23A, among the plurality of column electrode driving circuits 23, includes a timing controller IC 34. Such a structure is not practical for the following reason. The column electrode driving circuit 23A including the timing controller IC 34 needs to have a large output buffer in order to output a column electrode driving timing signal and a row electrode driving timing signal to the other column electrode driving circuits 23 and the other row electrode driving circuits 22, respectively.

In the display device disclosed in Japanese Laid-Open Publication No. 11-194713, the column electrode driving circuits and the row electrode driving circuits are mounted by COG (chip on glass). In such a case, the column electrode driving circuits and the row electrode driving circuits cannot be easily positionally aligned with lines provided on the glass substrate. Therefore, such a display device is not easily produced. In the Japanese Laid-Open Publication No 11-194713, lines are provided in the display section in order to avoid interference between the lines. This structure undesirably requires an area of the glass substrate around the display section to be enlarged.

A conventional display device, such as, for example, a liquid crystal display device includes, an external component (or external substrate), such as, for example, a gray scale reference power supply substrate, in addition to the display panel and the driver. Such an external component has an amplifier, such as a gray scale reference voltage amplifier or a common voltage amplifier, mounted thereon.

Japanese Laid-Open Publication No. 9-113876 discloses a structure of an output stage of a counter electrode driving circuit in a liquid crystal-display device. Japanese Laid-Open Publication. No. 8-171081 discloses a structure of a matrix type display device including a buffer for reserve lines.

In a conventional display device including a gray scale reference voltage amplifier and a common voltage amplifier on an external component, an area of the external component on which amplifiers or the like are mounted needs to be enlarged. This inevitably increases the size of, and raises the cost of the external component. In addition, the large number of lines between the external component and the drivers tends to generate connection defects and lower the production yield.

SUMMARY OF THE INVENTION

According to one aspect of the invention, a plurality of column electrode driving circuits is used in a matrix type display device including a plurality of row electrode driving circuits each for driving a plurality of row electrodes and the plurality of column electrode driving circuits each for driving a plurality of column electrodes. Each of the plurality of column electrode driving circuits includes a data input section for receiving a control data signal for the plurality of column electrodes; a timing control section for generating a timing control signal for controlling at least one of the row electrode driving circuit and the column electrode driving circuit; a selection section for selecting one of a signal in synchronization with the timing signal generated by the timing control section and the control data signal input to the data input section, based on the control data signal input to the data input section; and a data output section for outputting one of the signal in synchronization with the timing signal and the control data signal which is selected by the selection section. The data input section of a second column electrode driving circuit of the plurality of column electrode driving circuits is connected to the data output section of a first column electrode driving circuit of the plurality of column electrode driving circuits, and the data output section of the second column electrode driving circuit is connected to the data input section of a third column electrode driving circuit of the plurality of column electrode driving circuits.

In one embodiment of the invention, the data input section of the second column electrode driving circuit includes an external data input port for receiving an external control data signal and a transferred data input port for receiving a control data signal from the first column electrode driving circuit, the external data input port and the transferred data input port being switchable. The timing control section of the second column electrode driving circuit is switchable to an operation state or a non-operation state in accordance with the switching between the external data input port and the transferred data input port.

In one embodiment of the invention, the data input section of the second column electrode driving circuit receives one of the external data signal and the control data signal from the first column electrode driving circuit which is selectively input thereto. The timing control section of the second column electrode driving circuit is switchable to an operation state or a non-operation state by the external control data signal.

According to another aspect of the invention, a display device includes a display panel; the above-described plurality of column electrode driving circuits provided on the display panel; and a plurality of row electrode driving circuits provided on the display panel. The plurality of column electrode driving circuits are connected in series along a first side of the display panel, so that a scanning signal from the first column electrode driving circuit, among the plurality of column electrode driving circuits, which is closest to the plurality of row electrode driving circuits, is transferred in a cascading manner in the plurality of column electrode driving circuits. The plurality of row electrode driving circuits are connected in series along a second side of the display panel adjacent to the first side, so that the scanning signal from the first column electrode driving circuit is transferred in a cascading manner in the plurality of row electrode driving circuits. An external control data signal is input to the data input section of the first column electrode driving circuit and is output in synchronization with a timing signal generated by the timing control section of the first column electrode driving circuit. The external control data signal which is output from the first column electrode driving circuit is transferred sequentially in the rest of the plurality of column electrode driving circuits in a cascading manner. The timing signal is transferred sequentially in the plurality of row electrode driving circuits in a cascading manner as the scanning signal.

According to still another aspect of the invention a matrix type display device includes a display panel; a plurality of column electrode driving circuits arranged in a line and provided along a first side of the display panel; and a plurality of row electrode driving circuits arranged in a line and provided along a second side of the display panel, the second side being adjacent to the first side. A control data signal for driving the display panel is input to a first column electrode driving circuit, among the plurality of column electrode driving circuits, which is closest to the plurality of row electrode driving circuits. A timing signal for controlling an operation timing of the plurality of column electrode driving circuits and the plurality of row electrode driving circuits is generated in the first column electrode driving circuit, and the generated timing signal and a data signal are output to a second column electrode driving circuit, among the plurality of column electrode driving circuits, which is directly connected to the first column electrode driving circuit. The output data signal is transferred to a third column electrode driving circuit, among the plurality of column electrode driving circuits, which is directly connected to the second column electrode driving circuit. The generated timing signal is transferred in a cascading manner to the plurality of row electrode driving circuits as a scanning signal.

According to still another aspect of the invention, a matrix type display device includes a display panel; a plurality of column electrode driving circuits arranged in a line on a printed circuit board provided along a first side of the display panel; and a plurality of row electrode driving circuits arranged in a line and provided along a second side of the display panel, the second side being adjacent to the first side. Each of the plurality of column electrode driving circuits is mounted in a tape carrier package. A first column electrode driving circuit, among the plurality of column electrode driving circuits, which is closest to the plurality of row electrode driving circuits, generates a timing signal for controlling an operation timing of the plurality of column electrode driving circuits and the plurality of row electrode driving circuits, and outputs the generated timing signal to a first row electrode driving circuit, among the plurality of row electrode driving circuits, which is closest to the first column electrode driving circuit as a scanning signal. A timing signal which is output from the first column electrode driving circuit is supplied to the first row electrode driving circuit sequentially through a first line portion provided on the tape carrier package mounting the first column electrode driving circuit, a second line portion provided on the printed circuit board, a third line portion provided on the tape carrier package mounting the first column electrode driving circuit, and a fourth line portion provided on the display panel.

According to still another aspect of the invention, a matrix type display device includes a display panel; a plurality of column electrode driving circuits arranged in a line on a printed circuit board provided along a first side of the display panel; and a plurality of row electrode driving circuits arranged in a line and provided along a second side of the display panel, the second side being adjacent to the first side. A timing signal for controlling the plurality of row electrode driving circuits is supplied to one of the plurality of row electrode driving circuits sequentially through a second line portion provided on the printed circuit board, a third line portion provided on one of the plurality of column electrode driving circuits, and a fourth line portion provided on the display panel.

According to one aspect of the invention, a display device includes a display panel including a bus line section; and at least one driver for driving the bus line section included in the display panel. Each of the at least one driver includes an amplifier for generating a non-driving signal based on an input signal, the non-driving signal not contributing to driving of the bus line section.

According to the above-described structure, the driver includes a so-called free amplifier for generating a non-driving signal which does not contribute to driving of a bus line section. Therefore, the amplifier in the driver can act as an amplifier conventionally provided on a substrate separated from the display panel and the driver (i.e., an external substrate or an external component, such as, for example, a power supply substrate). By using the amplifier in the driver according to the present invention for generating a gray scale reference signal or a common electrode driving signal, it is not necessary to provide an amplifier for generating a gray scale reference signal or a common electrode driving signal on an external component. This simplifies the structure of, and reduces the cost of, the external component.

Since the driver includes the amplifier, and the amplifier acts as an amplifier conventionally provided on an external component, the number of lines for connecting the external component and the driver can be reduced. This is useful to prevent defective connection between the external component and the driver, thus increasing the production yield. Since the structure of the external component is simplified, the display device itself can be reduced in overall size, thickness and size of the peripheral portion around the display portion.

The term "bus line section" refers to a group of lines provided on one of two substrates of a display panel for supplying signals to pixels of the display panel. The bus line section includes signal electrodes (including source bus lines), scanning electrodes (including gate bus lines), and defect correction redundant lines. The "amplifier for generating a non-driving signal which does not contribute to driving of the bus line section" is different from an amplifier for amplifying an input signal to generate a driving signal for driving the bus line section.

In one embodiment of the invention, each of the at least one driver includes a first surface facing the display panel, and the first surface includes a first side in contact with the display panel and a second side facing the first side. Each of the at least one driver includes an input section, provided closer to the second side than the first side, through which the input signal is input, and an output section, closer to the second side than the first side, through which the non-driving signal is output.

An amplifier included in such a display device is preferably usable for generating a gray scale reference signal.

In one embodiment of the invention, each of the at least one driver includes a first surface facing the display panel, and the first surface includes a first side in contact with the display panel and a second side facing the first side. Each of the at least one driver includes an input section, provided closer to the second side than the first side, through which the input signal is input, and at least one output section, provided in at least one of a position closer to the second side than the first side and a position closer to the first side than the second side, through which the non-driving signal is output.

Such a structure increases the degree of design freedom for outputting a non-driving signal generated by the amplifier.

In one embodiment of the invention, the amplifier amplifies the input signal at a gain greater than 1 so as to generate the non-driving signal.

In an embodiment of the invention, the amplifier amplifies the input signal at a gain greater than 1 so as to generate the non-driving signal.

This structure is usable even in the case where the non-driving signal needs to have a voltage higher than the input voltage.

According to another aspect of the invention, a display device includes a display panel for providing a gray scale display by a gray scale voltage; and at least one driver for generating a gray scale signal having the gray scale voltage. Each of the at least one driver includes an amplifier for generating a gray scale reference signal having a gray scale reference voltage based on an input signal, and a gray scale signal generation section for generating a gray scale signal having the gray scale voltage based on the gray scale reference voltage.

Owing to such a structure, unlike the conventional liquid crystal display device, it is not necessary to provide an amplifier for generating a gray scale reference signal on an external component which is separate from the display panel and the driver. Therefore, the structure of the external component is simplified, and the production cost thereof is reduced. In addition, since the number of lines for connecting the external component and the driver can be reduced, the display device itself can be reduced in overall size, thickness and size of the peripheral portion around the display portion.

In one embodiment of the invention, each of the at least one driver includes a first surface facing the display panel, and the first surface includes a first side in contact with the display panel and a second side facing the first side. Each of the at least one driver includes an input section, provided closer to the second side than the first side, through which the input signal is input, and an output section, provided closer to the second side than the first side, through which the gray scale reference signal is output.

An amplifier included in such a display device is preferably usable for generating a gray scale reference signal.

In one embodiment of the invention, each of the at least one driver includes a first surface facing the display panel, and the first surface includes a first side in contact with the display panel and a second side facing the first side. Each of the at least one driver includes an input section, provided closer to the second side than the first side, through which the input signal is input, and at least one output section, provided in at least one of a position closer to the second side than the first side and a position closer to the first side than the second side, through which the gray scale reference signal is output.

Such a structure increases the degree of design freedom for outputting a gray scale reference signal generated by the amplifier.

In one embodiment of the invention, the amplifier amplifies the input signal at a gain greater than 1 so as to generate the gray scale reference signal.

Even when a D/A conversion circuit is used for generating a gray scale reference voltage, a desired range of gray scale voltages can be provided.

In one embodiment of the invention, the at least one driver are a plurality of drivers. Each of the plurality of drivers includes one or two amplifiers. A plurality of gray scale reference signals generated by the amplifiers included in the plurality of drivers have different gray scale reference voltages from each other, and each of the plurality of gray scale reference signals is input to each of the plurality of drivers.

Owing to such a structure, the number of amplifiers included in each of the plurality of drivers is reduced, while all or most of required gray scale reference signals can be generated by the amplifiers included in the drivers. In addition, since all the outputs from the amplifiers are input to each of the drivers, the display defect such that the displayed image has different display characteristics block by block due to non-uniform amplifier characteristics, do not occur.

According to still another aspect of the invention, a display device includes a display panel including two substrates, one of which has a common electrode provided thereon; and at least one driver for outputting a common electrode driving signal for driving the common electrode. Each of the at least one driver includes at least one amplifier for generating the common electrode driving signal based on an input signal.

Owing to such a structure, it is not necessary to provide an amplifier for generating a common electrode driving signal on an external component which is separate from the display panel and the driver. Therefore, the structure of the external component is simplified, and the production cost thereof is reduced.

In one embodiment of the invention, each of the at least one driver includes a first surface facing the display panel, and the first surface includes a first side in contact with the display panel and a second side facing the first side. Each of the at least one driver includes an input section, provided closer to the second side than the first side, through which the input signal is input, and at least one output section provided in at least one of a position closer to the second side than the first side and a position closer to the first side than the second side.

Such a structure increases the degree of design freedom for outputting a common electrode driving signal generated by the amplifier.

In one embodiment of the invention, the at least one driver are a plurality of drivers. Each of the plurality of drivers includes one amplifier.

Owing to such a structure, the required driving capability can be provided by the plurality of amplifiers. Thus, the size of the amplifier for generating a common electrode driving signal in each driver (buffer amplifier size) can be reduced.

According to still another aspect of the invention, a driver for driving a display panel includes a bus line section, the driver comprising an amplifier for generating a non-driving signal based on an input signal, the non-driving signal not contributing to driving of the bus line section.

According to the above-described structure, the driver includes a so-called free amplifier for generating a non-driving signal which does not contribute to driving of a bus line section. Therefore, the amplifier in the driver can act as an amplifier conventionally provided on a substrate separated from the display panel and the driver (i.e., an external substrate or an external component, such as, for example, a power supply substrate). By using the amplifier in the driver according to the present invention for generating a gray scale reference signal or a common electrode driving signal, it is not necessary to provide an amplifier for generating a gray scale reference signal or a common electrode driving signal on an external component. This simplifies the structure of, and reduces the cost of, the external component.

Since the driver includes the amplifier, and the amplifier acts as an amplifier conventionally provided on an external component, the number of lines for connecting the external component and the driver can be reduced. This is useful to prevent defective connection between the external component and the driver, thus increasing the production yield. Since the structure of the external component is simplified, the display device itself can be reduced in overall size, thickness and size of the peripheral portion around the display portion.

The terms "bus line section" and "amplifier for generating a non-driving signal which does not contribute to driving of the bus line section" refer the same as described above.

In one embodiment of the invention, the driver further includes a first surface facing the display panel, the first surface including a first side in contact with the display panel and a second side facing the first side; and an input section, provided closer to the second side than the first side, through which the input signal is input, and an output section, provided closer to the second side than the first side, through which the non-driving signal is output.

An amplifier included in such a driver is preferably usable for generating a gray scale reference signal.

In one embodiment of the invention, the driver further includes a first surface facing the display panel, the first surface including a first side in contact with the display panel and a second side facing the first side; and an input section, provided closer to the second side than the first side, through which the input signal is input, and at least one output section, provided in at least one of a position closer to the second side than the first side and a position closer to the first side than the second side, through which the non-driving signal is output.

Such a structure increases the degree of design freedom for outputting a non-driving signal generated by the amplifier.

In one embodiment of the invention, the amplifier amplifies the input signal at a gain greater than 1 so as to generate the non-driving signal.

This structure is usable even in the case where the non-driving signal needs to have a voltage higher than the input voltage.

Thus, the invention described herein makes possible the advantages of providing (1) a plurality of column electrode driving circuits usable in a display device for decreasing the size of the display device and allowing the display device to be produced more easily, and a compact and easy-to-produce display device despite including a plurality of column electrode driving circuits and a plurality of row electrode driving circuits; and (2) a display device having an external component having a simplified structure so as to reduce production cost and restricting deterioration in the production yield caused by a connection defect, and a driver usable for such a display device.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative examples with reference to the accompanying drawings.

EXAMPLE 1

Figure 1:
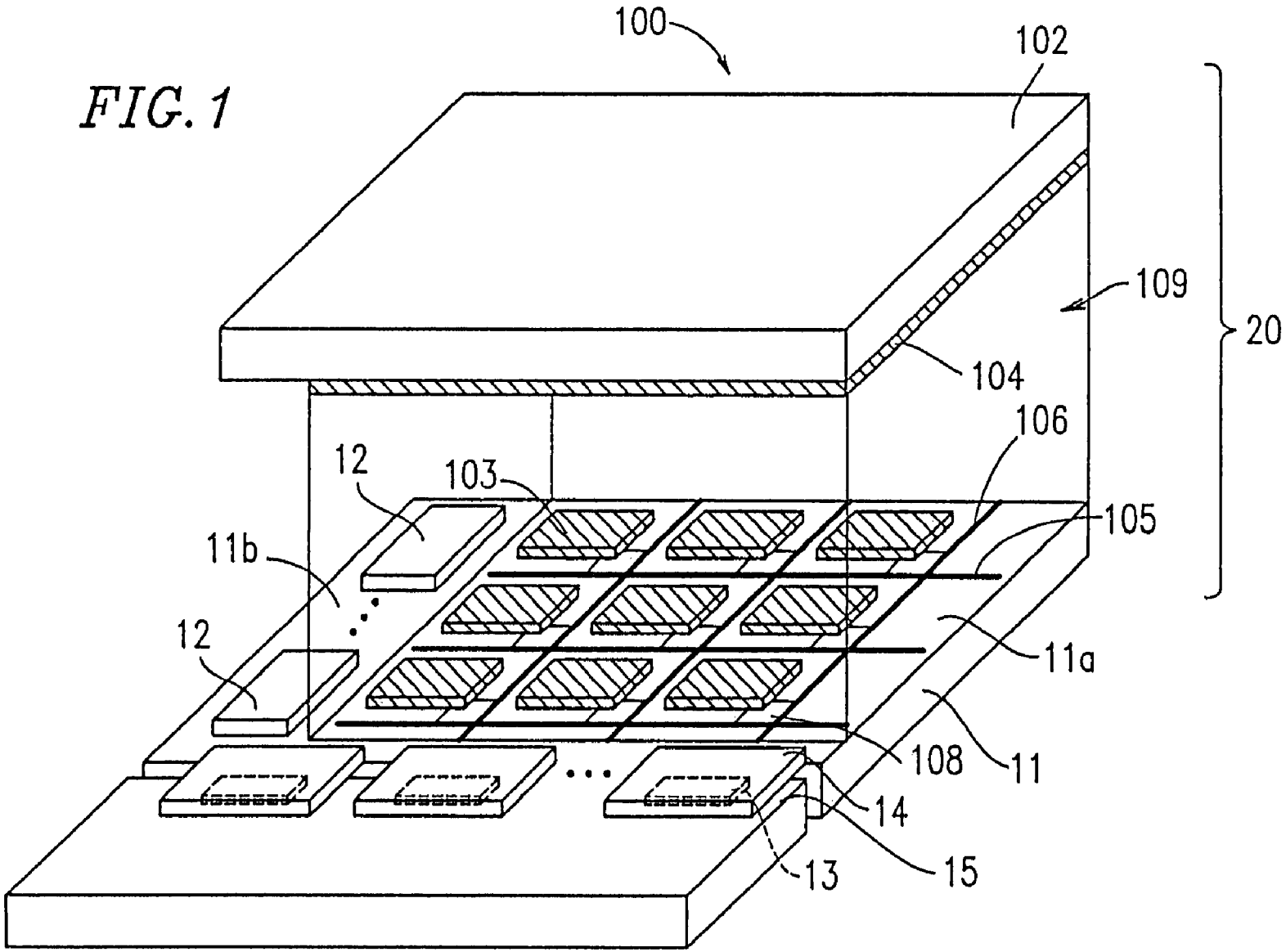
FIG. 1 is a schematic exploded isometric view of a liquid crystal display device according to one example of the present invention.

FIG. 1 is a schematic exploded isometric view of a liquid crystal display device 100 according to a first example of the present invention. The liquid crystal display device 100 is of an active matrix TFT (thin film transistor) array type, which includes TFTs as switching elements. This type of liquid crystal display device is advantageous for providing high quality display.

The liquid crystal display device 100 includes a display panel 20. The display panel 20 includes a control glass substrate 11, a counter glass substrate 102, and a liquid crystal layer 109 interposed between the control glass substrate 11 and the counter glass substrate 102.

The control glass substrate 11 is rectangular and includes a rectangular display section 11*a* and a rectangular non-display section 11*b* along one side of the display section 11*a*.

A printed circuit board 15 for column electrodes is provided along one side of the control glass substrate 11. The one side of the control glass substrate 11 along which the printed circuit board 15 is provided is adjacent to the side of the display section 11*a* along which the non-display section 11*b* is provided. There is a gap between the control glass substrate 11 and the printed circuit board 15.

The counter glass substrate 102 has a common electrode 104 provided entirely on a surface thereof, the surface being closer to the liquid crystal layer 109 than the other surface.

Figure 2:
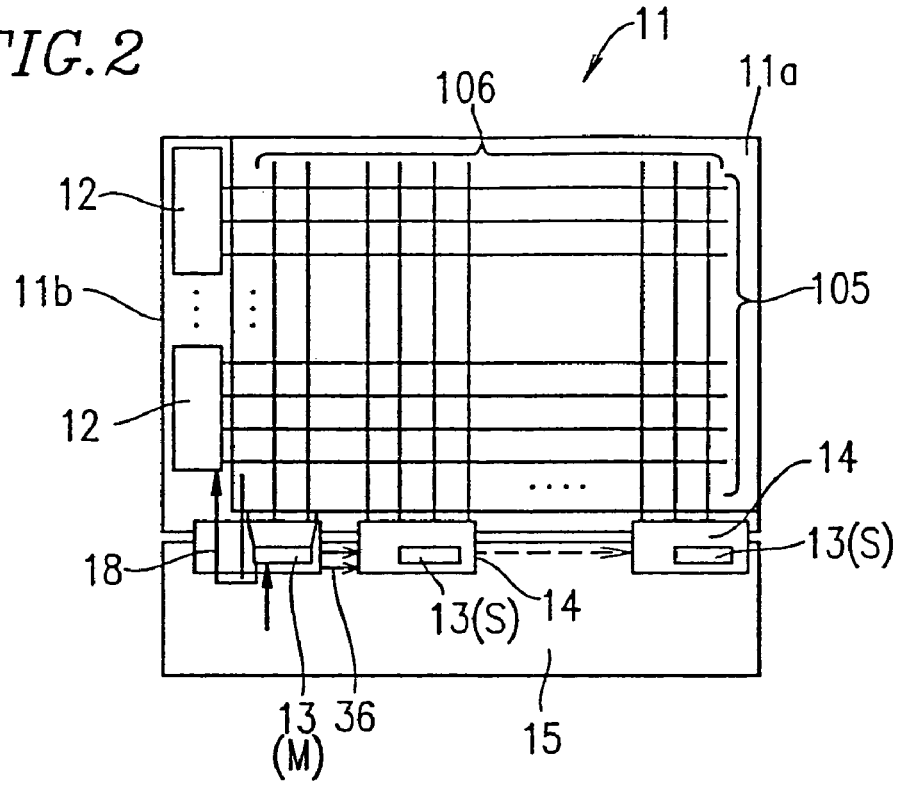
FIG. 2 is a schematic partial plan view of the liquid crystal display device shown in FIG. 1.

FIG. 2 is a schematic plan view of the control glass substrate 11 and the printed circuit board 15.

With reference to FIGS. 1 and 2, the display section 11*a* has a plurality of gate electrodes 105, a plurality of source electrodes 106, a plurality of TFTs 108, and a plurality of pixel electrodes 103 provided thereon. In this specification, the term "bus line section" refers to a section including the plurality of gate electrodes 105 and the plurality of source electrodes 106. The plurality of gate electrodes 105 are parallel to each other, and the plurality of source electrodes 106 are parallel to each other. The plurality of gate electrodes 105 and the plurality of source electrodes 106 are substantially perpendicular to each other.

On the non-display section 11*b*, a plurality of row electrode driving circuits (gate driver ICs) 12 each for driving the plurality of gate electrodes 105 are arranged in a line.

A plurality of TCPs (Tape Carrier Packages) 14 are provided to straddle the gap between the printed circuit board 15 and the control glass substrate 11. The plurality of TCPs are arranged in a line. The plurality of TCPs respectively mount a plurality of column electrode driving circuits (source driver ICs) 13 each for driving a plurality of source electrodes 106. In this specification, the plurality of row electrode driving circuits 12 and the column electrode driving circuit 13 are comprehensively referred to as a "driver". A driver drives the bus line section in the display panel 20.

The liquid crystal layer 109 includes a liquid crystal material, which is controlled by the plurality of pixel electrodes 103 provided on the control glass substrate 11 and a common electrode 104 provided on the counter glass substrate 102. The plurality of pixel electrodes 103 are each connected to a corresponding source electrode 106 via a corresponding TFT (switching element) 108, and a gate of each TFT 108 is connected to a corresponding gate electrode 105.

The liquid crystal layer 109 (FIG. 1) is provided in an area corresponding to the display section 11*a* of the control glass substrate 11. The pixel electrodes 103 (FIG. 1) are used for displaying each of the RGB colors in a 64 gray scale based on 6-bit digital data of each of the R (red), G (green) and B (blue) colors.

Each of the plurality of row electrodes 105 is supplied with a scanning signal for selecting the row electrode 105, and each of the plurality of column electrodes 106 is supplied with a display data signal for realizing gray scale display in accordance with the display data signal.

Figure 3A:
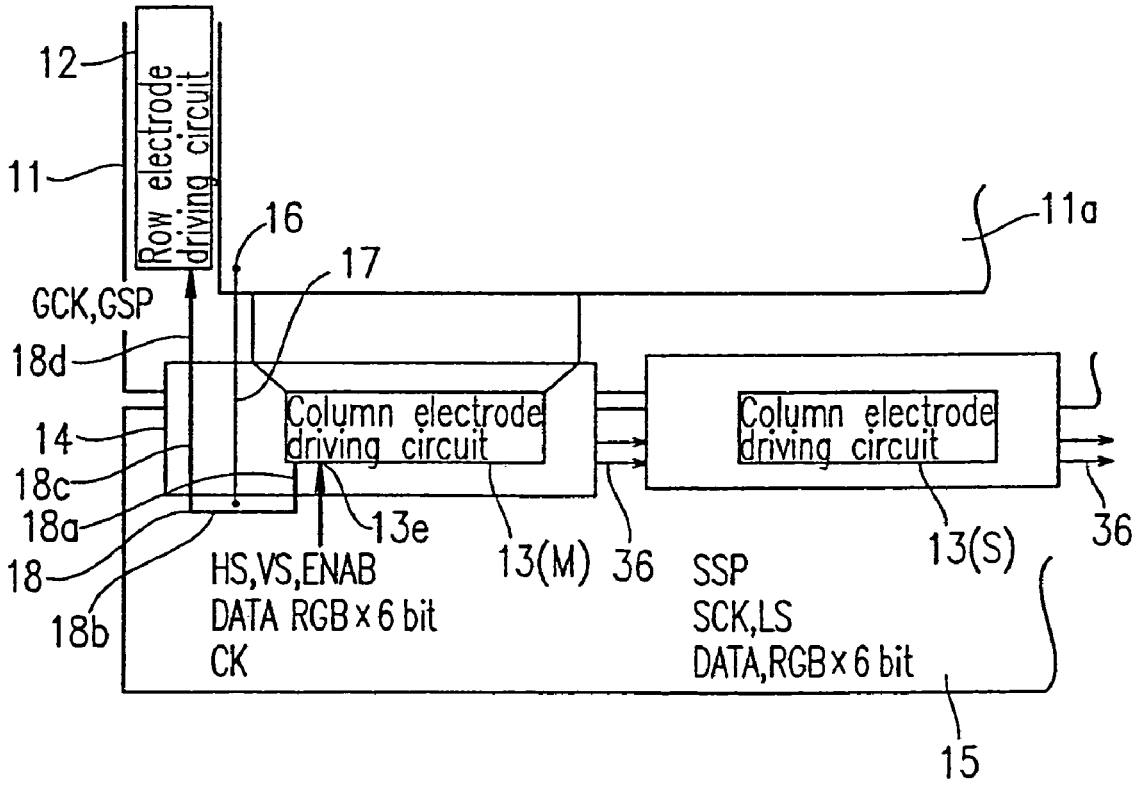
FIG. 3A is a schematic enlarged partial plan view of the liquid crystal display device shown in FIG. 1.

FIG. 3A is an enlarged partial view of FIG. 2. With reference to FIGS. 2 and 3A, the row electrode driving circuits 13 are connected in series by a line 36.

In this example, the row electrode driving circuits 12 are mounted on the control glass substrate 11. Alternatively, the row electrode driving circuits 12 can be respectively mounted in TCPs and provided on a printed circuit board, like the column electrode driving circuits 13.

Figure 4A:
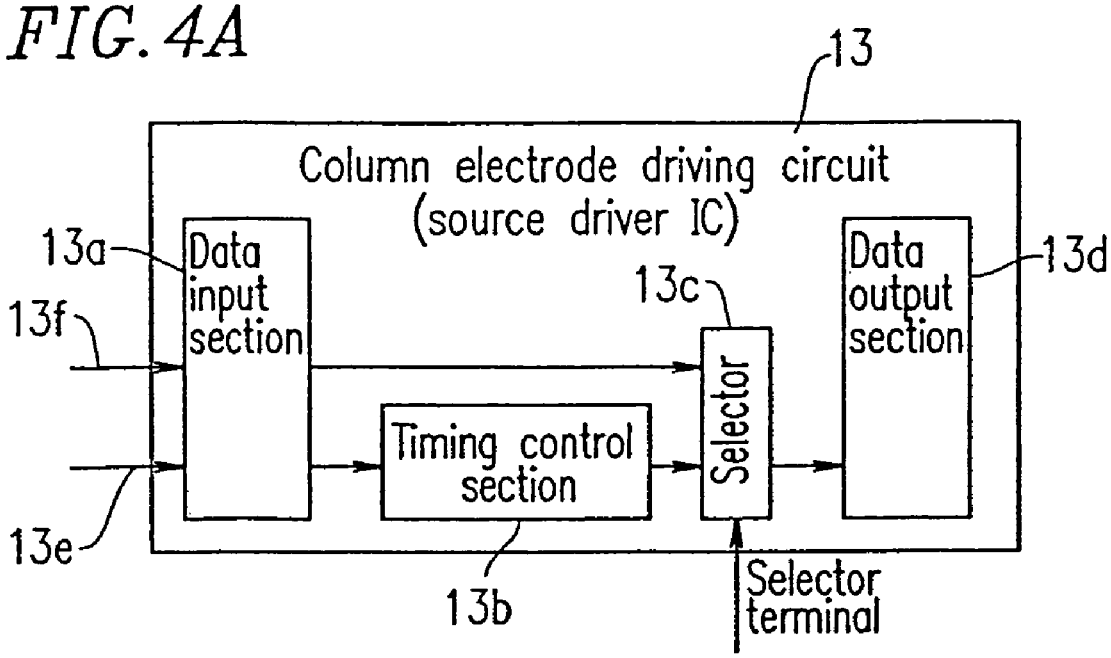
FIG. 4A is a block diagram illustrating an internal structure of a column electrode driving circuit usable in the liquid crystal display device shown in FIG. 1.

FIG. 4A is a block diagram illustrating an internal structure of one of the plurality of column electrode driving circuits 13. The other column electrode driving circuits 13 can have a similar structure.

As shown in FIG. 4A, the column electrode driving circuit 13 includes a data input section 13*a* for receiving a control data signal. The column electrode driving circuit 13 also includes a timing control section 13*b* for generating a column electrode driving timing signal and a row electrode driving timing signal based on the control data signal which is input to the data input section 13*a*. An output from the data input section 13*a* and an output from the timing control section 13*b* are supplied to a data output section 13*d* via a selector 13*c*.

The data input section 13*a* includes an external data input port 13*e* for receiving the control data signal from an external device, and a transferred data input port 13*f* for receiving the control data signal which is output from the previous column electrode driving circuit 13 when the plurality of column electrode driving circuits 13 are connected. The control data signal is a display data signal for each of the RGB colors, a clock signal CK, a horizontal synchronous signal HS, a vertical synchronous signal VS, or an enable signal ENAB.

Either one of the external data input port 13*e* and the transferred data input port 13*f* is selected to be used.

The timing control section 13*b* is switchable to an operation state in which a column electrode driving timing signal and/or a row electrode driving timing signal are generated or to a non-operation state in which neither a column electrode driving timing signal nor a row electrode driving timing signal is generated. When a control data signal is input to the external data input port 13*e* of the data input section 13*a*, the timing control section 13*b* is placed into the operation state. When a control data signal is input to the transferred data input port 13*f* of the data input section 13*a*, the timing control section 13*b* is placed into the non-operation state.

Among the plurality of column electrode driving circuits 13 having such a structure, one column electrode driving circuit 13 which is closest to the row electrode driving circuits 12 will be referred to as a "master column electrode driving circuit 13M". The master column electrode driving circuit 13M receives a control data signal from a device external to the liquid crystal display device 100 or the column electrode driving circuits 13, and the timing control section 13*b* is placed into the operation state.

The column electrode driving circuits 13 other than the master column electrode driving circuit 13M will be each referred to as a "slave column electrode driving circuit 13S". In each of the slave column electrode driving circuits 13S, the transferred data input port 13*f* is selected. Accordingly, the timing control section 13*b* of each of the slave column electrode driving circuits 13S is placed into the non-operation state. The slave column electrode driving circuit 13S connected to the master electrode driving circuit 13M receives, at the transferred data input port 13*f*, the control data signal which is output from the master electrode driving circuit 13M. The other slave column electrode driving circuits 13S each receive, at the transferred data input port 13*f*, the control data signal which is output from the previous slave electrode driving circuit 13S.

In the master column electrode driving circuit 13M, the control data signal which is input to the data input section 13*a* through the external data input port 13*e* is supplied to the timing control section 13*b*. A column electrode driving timing signal and a row electrode driving timing signal generated by the timing control section 13*b* and the data signal are supplied to the selector 13*c*. The selector 13*c* sends the column electrode driving timing signal, the row electrode driving timing signal, and the data signal to the data output section 13*d*.

The data output section 13*d* outputs the control data signal (including a timing signal SCK, SSP, LS, DATA signal, and RGB×6 bits) to the slave column electrode driving circuit 13S connected thereto by the line 36 in synchronization with the column electrode driving timing signal and the row electrode driving timing signal. The data output section 13*d* also outputs the row electrode driving timing signal generated by the timing control section 13*b* to the row electrode driving circuit 12 which is closest to the master column electrode driving circuit 13M as a scanning signal such as, for example, a gate start pulse (GSP) or a gate clock (GCK).

Based on the data control signal, each of the column electrodes 106 connected to the master column electrode driving circuit 13M is controlled.

In each of the slave column electrode driving circuits 13S, the control data signal which is output from the previous column electrode driving circuit 13 is input to the data input section 13*a* through the transferred data input port 13*f*. The control data signal is supplied to the selector 13*c*. The timing control section 13*b* is in the non-operation state. Thus, the selector 13*c* outputs the control data signal supplied from the data input section 13*a* to the data output section 13*d* without any change. The data output section 13*d* transfers the control data signal to the slave column electrode driving circuit 13S directly connected thereto via the line 36.

Thus, each of the slave column electrode driving circuits 13S transfers a control data signal from the master column electrode driving circuit 13M or the previous slave column electrode driving circuit 13S to the subsequent column electrode driving circuit 13S sequentially in a cascading manner.

Each of the column electrodes 106 connected to each slave column electrode driving circuit 13S is controlled based on the control data signal.

Figure 4B:
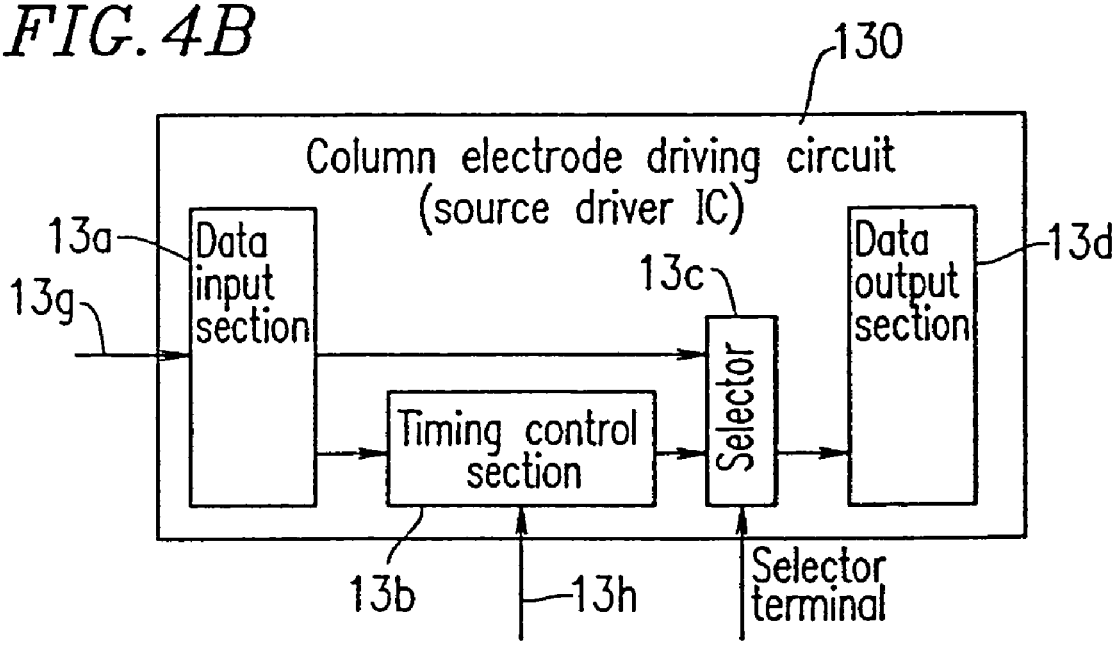
FIG. 4B is a block diagram illustrating an internal structure of another column electrode driving circuit usable in the liquid crystal display device shown in FIG. 1.
Figure 5:
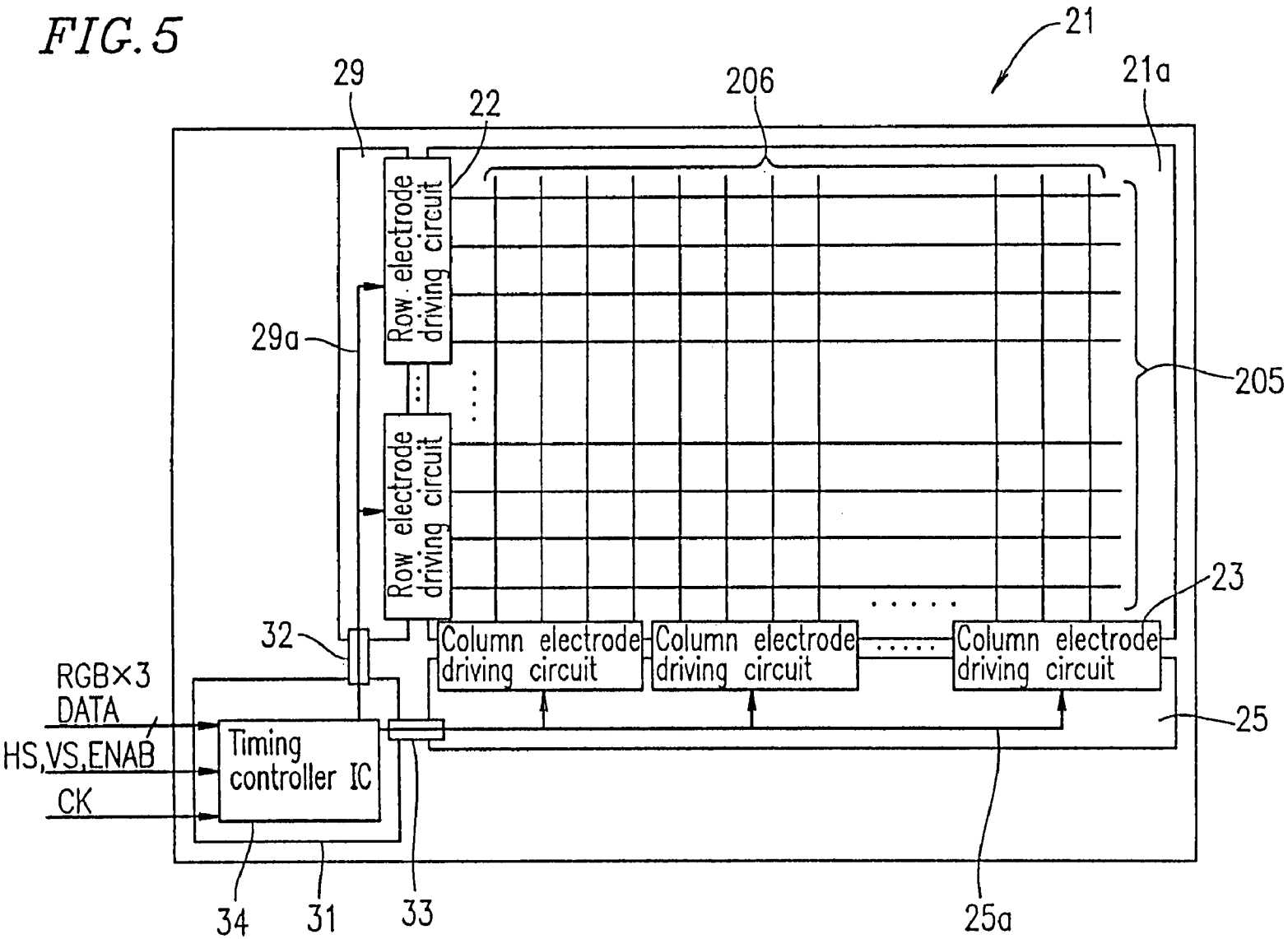
FIG. 5 is a plan view illustrating a schematic structure of a conventional liquid crystal display device.
Figure 6:
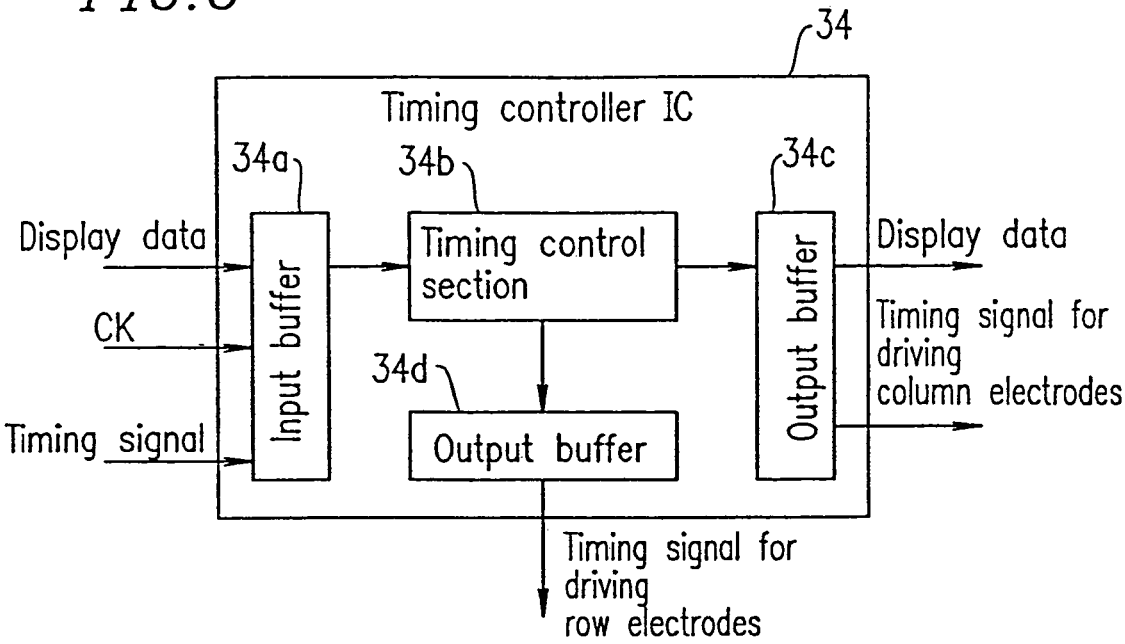
FIG. 6 is a block diagram illustrating an internal structure of a timing controller IC usable in the conventional liquid crystal display device.
Figure 7:
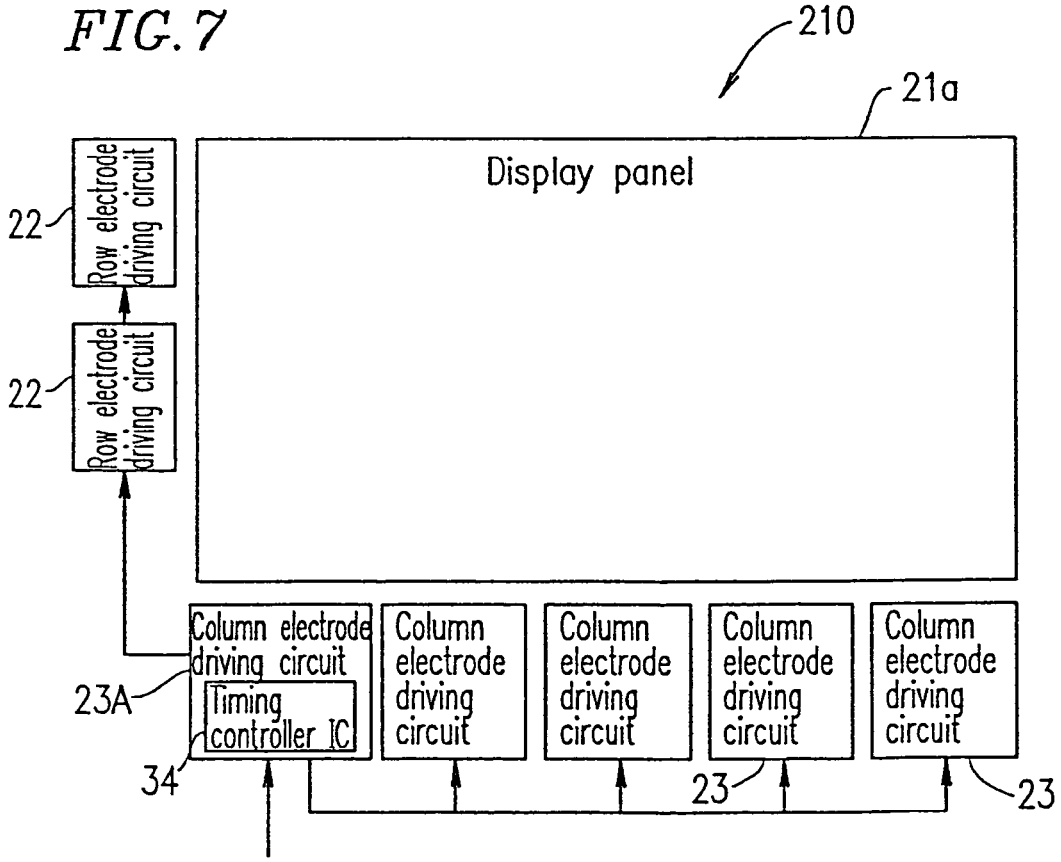
FIG. 7 is a schematic plan view of another conventional liquid crystal display device.

FIG. 4B is a block diagram illustrating another internal structure of each of a plurality of column electrode driving circuits 130.

As shown in FIG. 4B, in the column electrode driving circuit 130, a data input section 13*a* includes one data input port 13*g*. Either an external control data signal from an external device or a transferred data signal which is output from the previous column electrode driving circuit 130 is selectively input to the data input port 13*g*. The timing control section 13*b* is switchable to an operation state or to a non-operation state by the external control data signal. Alternatively, the timing control section 13*b* is switchable by an external control signal supplied to a control terminal 13*h* included in the timing control section 13*b*.

Among the plurality of column electrode driving circuit 130 having such a structure, one column electrode driving circuit 130 which is closest to the row electrode driving circuits 12 will be referred to as a "master column electrode driving circuit 130M". The other column electrode driving circuits 130 will be each referred to as a "slave column electrode driving circuit 130S". The reference numerals 130M and 130S are not indicated in the figures but will be used for the sake of clarity.

In the master column electrode driving circuit 130M, an external control data signal is input to the data input port 13*g*, and the timing control section 13*b* is placed into the operation state by the external control signal which is input from the control terminal 13*h*. At this point, the selector 13*c* outputs the control data signal input from the data input section 13*a* to the data output section 13*d* in synchronization with the column electrode driving timing signal and the row electrode driving timing signal generated by the timing control section 13*b*. The selector 13*c* also outputs the column electrode driving timing signal and the row electrode driving timing signal themselves.

In each of the slave column electrode driving circuits 130S, the control data signal is input from the master column electrode driving circuit 130M or the previous slave column electrode driving circuit 130S through the data input port 13*g* as a transferred data signal. The timing control section 13*b* is placed into the non-operation state by the external control signal which is input from the control terminal 13*h*. The selector 13*c* outputs the control data signal to the data output section 13*d* without any change, and the data output section 13*d* outputs the control data signal.

The line 36 (FIG. 3A) used for transferring the control data signal in a cascading manner from the master column electrode driving circuit 13M or each slave column electrode driving circuit 13S can be provided either on the printed circuit board 15 or the control glass substrate 11.

As shown in FIG. 3A, a scanning signal which is output from the master column electrode driving circuit 13M is output to the row electrode driving circuit 12 closest to the master column electrode driving circuit 13M via a scanning signal line 18. The scanning signal line 18 is provided so as not to cross a common signal line 17 connected to the common electrode 104 provided on the counter glass substrate 102 (FIG. 1). In FIG. 3A, the common signal line 17 is shown for the purpose of comparison. The common signal line 17 is linearly provided from the printed circuit board 15 over the TCP 14 mounting the master column electrode driving circuit 13M, so that an end thereof is positioned on the control glass substrate 11. The common signal line 17 is connected to the common electrode 104 at a connection point 16 at a corner of the display section 11*a* of the control glass substrate 11.

The scanning signal line 18 includes a first portion 18*a* provided on the TCP 14 so as to be parallel to the common signal line 17, a second portion 18*b* provided on the printed circuit board 15 in connection with the first portion 18*a* so as to partially surround the common signal line 17, a third portion 18*c* provided in connection with the second portion 18*b* so as to cross the TCP 14, and a fourth portion 18*d* provided on the control glass substrate 11 of the display panel 20 (FIG. 1) in connection with the third portion 18*c*. The first portion

18*a*, the second portion 18*b*, the third portion 18*c* and the fourth portion 18*d* are thus provided so as not to cross the common signal line 17.

A scanning signal output from the master column electrode driving circuit 13M is supplied to the row electrode driving circuit 12 closest to the master column electrode driving circuit 13M sequentially through the first, second, third and fourth portions 18*a*, 18*b*, 18*c* and 18*d* of the scanning signal line 18. The scanning signal is then transferred to the other row electrode driving circuits 12 in a cascading manner.

In this example, no gate substrate is provided. Alternatively, a gate substrate can be provided so that the row electrode driving circuits 12 are provided on the gate substrate. In such a case, each of the row electrode driving circuits 12 acts in a manner similar to the manner described above.

In the liquid crystal display device 100 (FIG. 1) having such a structure, each of the column electrodes 106 connected to the master column electrode driving circuit 13M is controlled based on the control data signal for each of the RGB colors, the clock signal CK, the horizontal synchronous signal HS, the vertical synchronous signal VS, the enable signal ENAB and the like which are input to the master column electrode driving circuit 13M.

A control data signal, which is input to the master column electrode driving circuit 13M, is transferred to the slave column electrode driving circuit 13S directly connected thereto in synchronization with a column electrode driving timing signal generated by the timing control section 13*b* of the master column electrode driving circuit 13M. Each of the column electrodes 106 connected to the slave column electrode driving circuit 13S is controlled by the transferred control data signal. The control data signal, which is input to the above-mentioned slave column electrode driving circuit 13S, is transferred to the subsequent slave column electrode driving circuit 13S in synchronization with the timing at which the next control data signal is input.

This operation is repeated. Thus, a control data signal is sequentially transferred to the slave column electrode driving circuits 13S in a cascading manner. Each of the column electrodes 106 connected to each of the slave column electrode driving circuits 13S is controlled based on the control data signal transferred to the respective slave column electrode driving circuit 13S.

The master column electrode driving circuit 13M outputs a row electrode driving timing signal generated by the timing control section 13*b* thereof to the row electrode driving circuit 12 closest thereto via the scanning signal line 18 as a scanning signal such as, for example, a GSP or a GCK. The row electrode driving circuit 12 controls each of the column electrodes 105 connected thereto based on the received scanning signal. The scanning signal input to the row electrode driving circuit 12 is sequentially transferred to the subsequent row electrode driving circuits 12 in synchronization with the timing at which the next scanning signal is input.

This operation is repeated. Thus, a scanning signal is sequentially transferred to the row electrode driving circuits 12 in a cascading manner. Each of the row electrodes 105 connected to each of the row electrode driving circuits 12 is driven based on the scanning signal transferred to the respective row electrode driving circuit 12.

As described above, according to the present invention, the master column electrode driving circuit 13M includes the timing control section 13*b* for generating a column electrode driving timing signal and a row electrode driving timing signal. Such a structure can eliminate the timing controller IC for generating the column electrode driving timing signal and the row electrode driving timing signal, a substrate for mounting the timing controller IC and the like and therefore an FPC for electrically connecting the timing controller IC to the printed circuit board for the column electrodes or the like. As a result, the liquid crystal display device 100 has a smaller overall size and can be assembled and produced more easily.

The control data signal for each of the slave column electrode driving circuits 13S is transferred from the master column electrode driving circuit 13M or the previous column electrode driving circuit 13S. Therefore, the data output section 13*d* in each of the column electrode driving circuits 13S needs to have only the capability of transferring the control data signal via the line 36, which is relatively short. Thus, each of the column electrode driving circuits 13 can be more compact.

The scanning signal for each of the row electrode driving circuits 12 is transferred from the previous row electrode driving circuit 12. Therefore, the line for transferring the scanning signal can be shorter, and thus each of the row electrode driving circuits 12 can be more compact.

In the above example, the master column electrode driving circuit 13M and the slave column electrode driving circuits 13S have a similar structure, so that the function of the master circuit and the slave circuit can be changed by a manipulation from an external device. Therefore, the column electrode driving circuits 13 can be mounted on the printed circuit board 15 without considering which is the master circuit and which are the slave circuits. Thus, each of the column electrode driving circuit 13 can be mounted efficiently using a conventional mounting device of column electrode driving circuits.

The column electrode driving circuits 13 are each provided on the printed circuit board 15 in the state of being mounted in the respective TCP 14. Due to such a structure, the scanning signal line 18 for supplying a scanning signal from the master column electrode driving circuit 13M to the row electrode driving circuit 12 can be easily formed on the TPC 14 and the printed circuit board 15 so as not to cross the common signal line 17. In a structure where the column electrode driving circuits are formed on a glass substrate by COG (chip on glass), the freedom is limited in providing a scanning signal line and it is difficult to connect the line on the glass substrate and the column electrode driving circuits.

In the above example, the liquid crystal display device 100 is used as an example of a display device. The present invention is applicable to a wide variety of display devices.

Figure 3B:
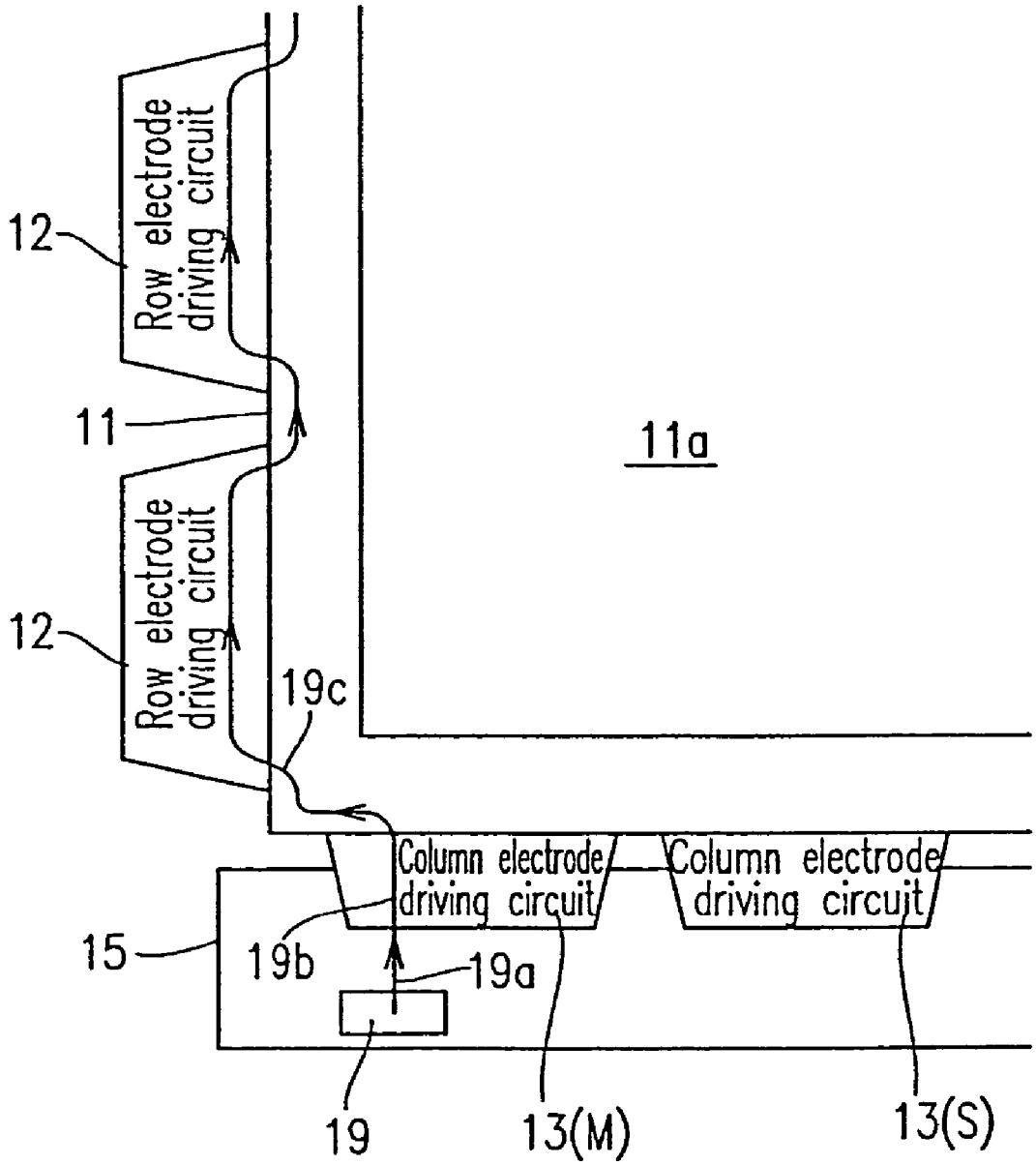
FIG. 3B is a schematic enlarged partial plan view of another liquid crystal display device according to the present invention.

FIG. 3B is an enlarged plan view schematically illustrating a part of a liquid crystal display device according to another example of the present invention.

In the liquid crystal display device shown in FIG. 3B, a timing signal for controlling each of the row electrode driving circuits 12 is generated by an element other than the column electrode driving circuits 13 (for example, a timing signal generation circuit 19 formed of a dedicated IC). A scanning signal line includes a second portion 19*a* provided on the printed circuit board 15, a third portion 19*b* provided on one of the plurality of column electrode driving circuits 13, and a fourth portion 19*c* provided on the control glass substrate 11 of the display panel 20. The timing signal generated by the timing signal generation circuit 19 can be supplied to one of the plurality of row electrode driving circuits 12 sequentially through the second portion 19*a*, the third portion 19*b* and the fourth portion 19*c*.

In such a structure, a timing signal can be supplied to the row electrode driving circuits 12 without using a printed circuit board for row electrode driving circuits. As a result, a simpler and more compact structure, lower production cost and high productivity are provided.

The timing signal generation circuit 19 is not necessarily required to be in the column electrode driving circuits 13, and can be provided on the printed circuit board 15 or outside the printed circuit board 15. For example, an external dedicated LSI can have a timing signal generation function as a part of a logic circuit. In such a case, the restriction on the space for the timing signal generation circuit is reduced so as to improve the geographical freedom.

A plurality of column electrode driving circuits according to the present invention decreases the size of the display device and allows the display device to be produced more easily.

EXAMPLE 2

With reference to FIGS. 8 through 12, a liquid crystal display device according to a second example of the present invention will be described.

The liquid crystal display device according to the second example is substantially the same as that of the liquid crystal display device 100 shown in FIG. 1 except for the structure of the driver.

Figure 8:
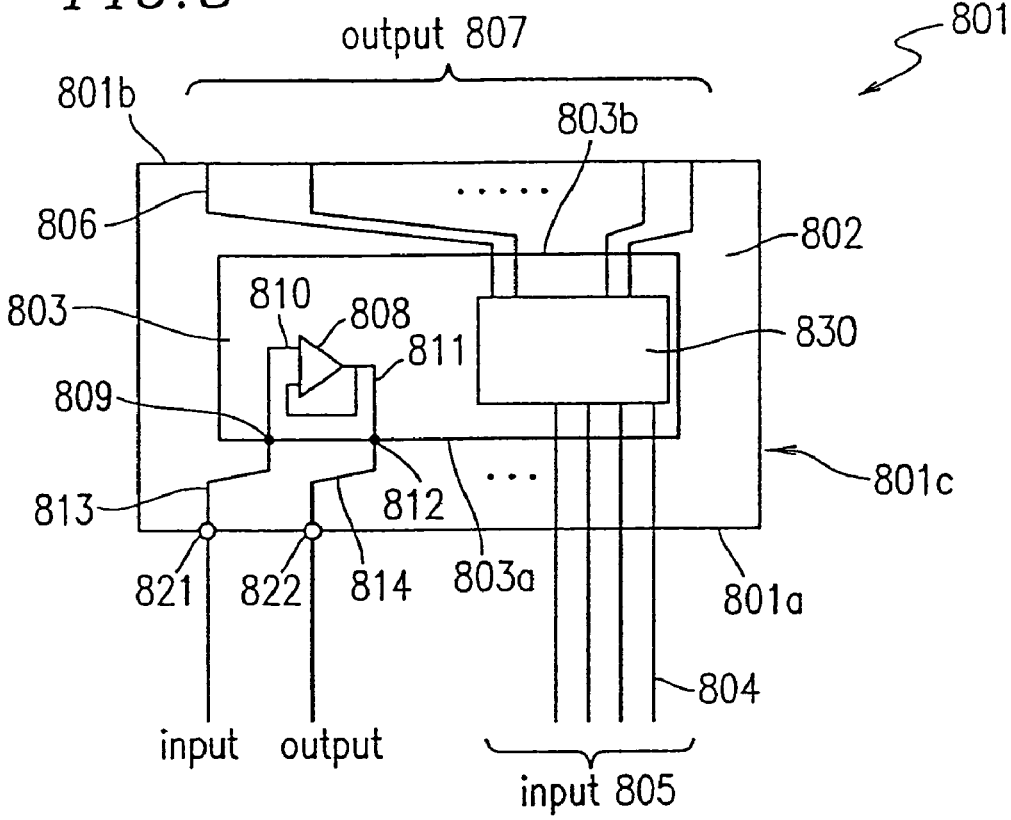
FIG. 8 shows a structure of a driver included in a display device according to another example of the present invention.

FIG. 8 shows a structure of a driver 801 included in the liquid crystal display device in this example. The driver 801 includes an insulating substrate 802 and an IC chip (driving circuit) 803.

The insulating substrate 802 has an input line pattern 805 and a output line pattern 807 provided thereon. The input line pattern 805 includes a plurality of input lines 804 arranged in a prescribed pattern. The output line pattern 807 includes a plurality of output lines 806 arranged in a prescribed pattern. The IC chip 803 includes an amplifier 808 (acting as a current-amplification section) for generating a non-driving signal which does not contribute to driving of the bus line section, and a driving circuit 830. The driving circuit 830 generates a driving signal for driving the bus line section based on a signal which is input thereto via one of the plurality of input lines 804 and outputs the generated driving signal to the bus line via one of the plurality of output lines 806.

The bus line section is provided on the display panel 20 (FIG. 1) and supplies a signal to the respective pixel in the display panel 20. The bus line section includes signal electrodes (including source electrodes 106 shown in FIG. 1) and scanning electrodes (including the gate electrodes 105 shown in FIG. 1) provided in the display panel 20, and a defect correction redundant line. The "amplifier for generating a non-driving signal which does not contribute to driving of the bus line section" is different from an amplifier for amplifying an input signal to generate a driving signal for driving the bus line section.

The driver 801 includes such an amplifier 808 (a so-called free amplifier). The amplifier 808 has the same function as that of an amplifier which is conventionally provided on a separate substrate from the display panel and the driver (for example, an external component such as a so-called power supply substrate). For example, the amplifier 808 can generate a gray scale reference signal or generate a common electrode driving signal. In this case, the separate substrate need not have thereon an amplifier for generating a gray scale reference signal or an amplifier for generating a common electrode driving signal, unlike in the conventional display device. This simplifies the structure of, and reduces the cost of, the external component.

The driver 801 includes the amplifier 808, and the amplifier 808 acts as an amplifier conventionally provided on an external component (or an external substrate). Therefore, the number of lines for connecting the external component and the driver 801 can be reduced. This prevents connection defects between the external component and the driver 801, and thus improves the production yield of the display device. Since the structure of the external component can be simplified, the display device including the external component can be reduced in overall size, thickness and size of the peripheral portion around the display portion.

The driver 801 can operate as follows. In the following description, an "input signal" includes a voltage signal.

An input signal is input to the amplifier 808 from an input section 809, provided on an input side 803*a* of the IC chip 803, via a line 810. A non-driving signal generated by the amplifier 808 is output from an output section 812, provided on the input side 803*a* of the IC chip 803, via a line 811. Owing to such a structure, the amplifier 808 is preferably used for forming a gray scale reference signal, as described below in more detail.

The driver 801 includes a first surface 801*c* facing the display panel 20 (FIG. 1), and the first surface 801*c* includes a first side 801*b* in contact with the display panel 20 and a second side 801*a* facing the first side 801*b*. The driver 801 may have a generally rectangular shape, but is not limited to having such a shape.

The input section 809 is connected to a line 813 on the insulating substrate 802. The line 813 extends to the second side 801*a*, and is connected to a line on another substrate (not shown) at an input section 821 provided closer to the second side 801*a* than the first side 801*b*. The output section 812 is connected to a line 814 on the insulating substrate 802. The line 814 extends to the second side 801*a*, and is connected to a line on the another substrate at an output section 822 provided closer to the second side 801*a* than the first side 801*b*.

The output lines 806 on the insulating substrate 802 are connected to the bus line section on the display panel 20. A driving signal generated by the driving circuit 830 of the IC chip 803 is supplied to the bus line section through one of the output lines 806. A signal supplied from the another substrate in the vicinity of the second side 801*a* of the driver 801 is input to the IC chip 803 through one of the input lines 804.

In order to supply an output of the amplifier 808 to the first side 801*b* and the vicinity thereof, the output section 812 can be provided on the output side 803*b* of the IC chip 803, so that an output signal from the amplifier 808 is output from the output side 803*b*.

Figure 9:
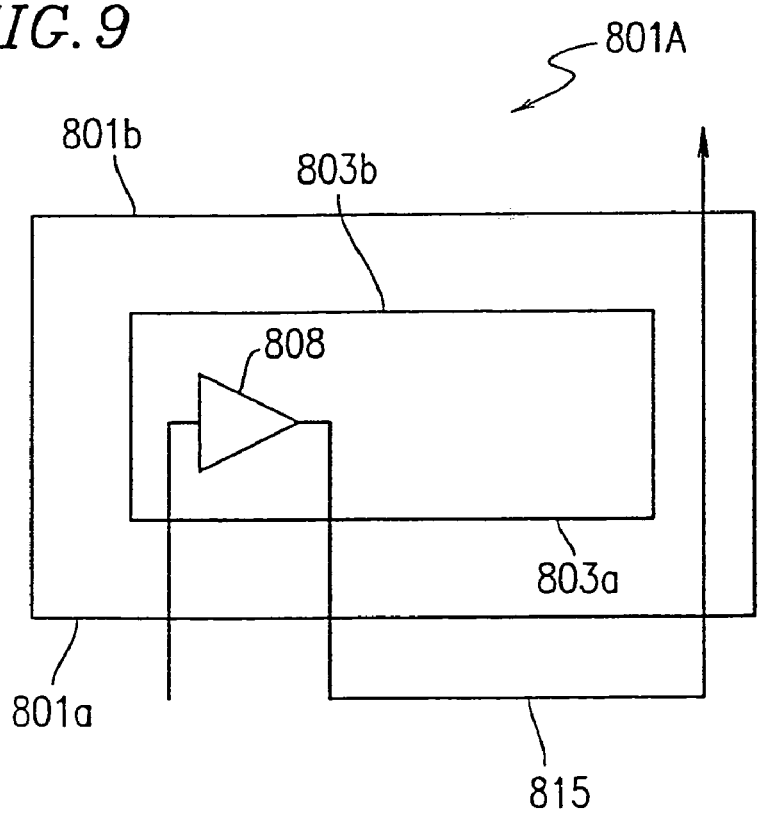
FIG. 9 shows a structure of another driver which can be included in the display device according to the present invention.

FIG. 9 shows a driver 801A usable in the display device according to the second example. The driver 801A is substantially the same as the driver 801 except for a line for outputting a signal from the amplifier 808. FIG. 9 shows an output line 815 for outputting a signal from the amplifier 808, but omits some of the elements for simplicity.

In the example shown in FIG. 9, the output line 815 goes out of the driver 801 from the second side 801*a* and the vicinity thereof, and then re-enters the driver 801 from the second side 801*a* and the vicinity thereof so as to bypass the driving circuit 830. The output line 815 finally goes out from the first surface 801*b* and the vicinity thereof.

The output line for the amplifier 808 is not limited to having the structure shown in FIG. 8 or 9. The driver may have an output line going out both from the first side 801*b* and the vicinity thereof, and the second side 801*a* and the vicinity thereof.

Figure 10:
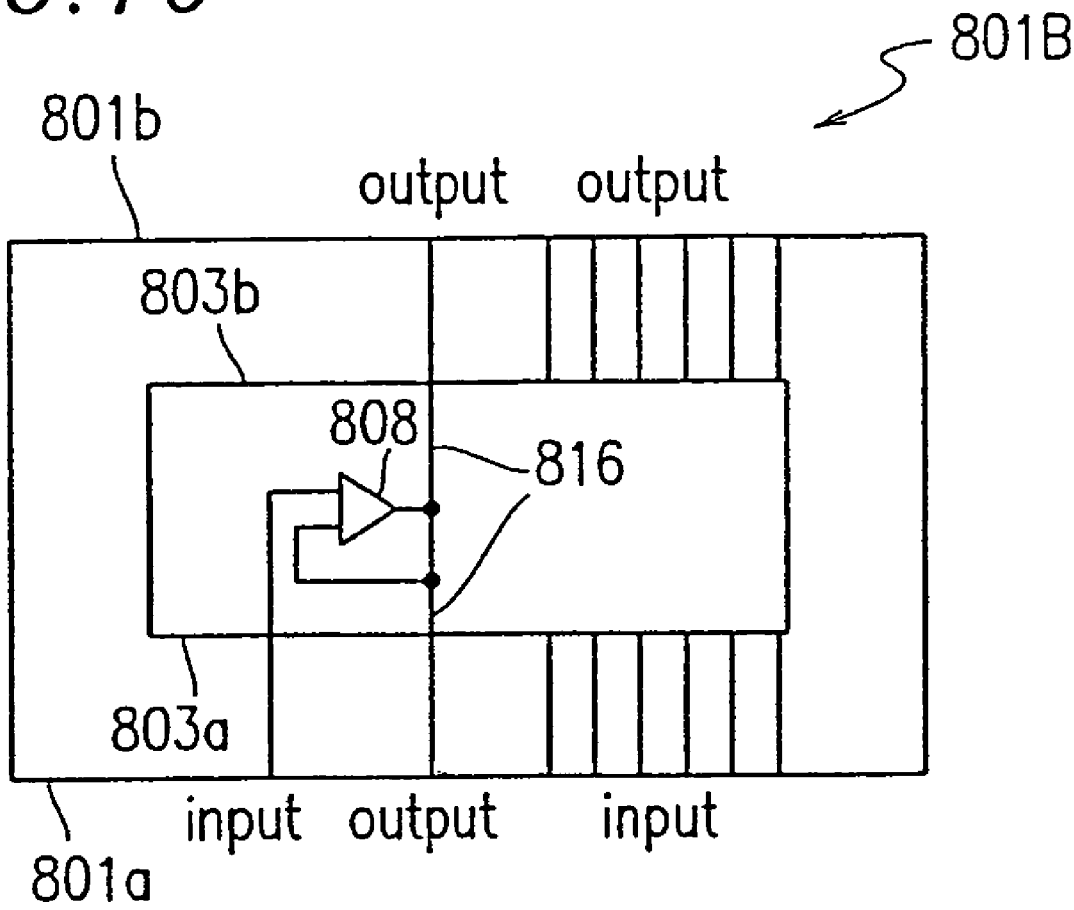
FIG. 10 shows a structure of still another driver included in a display device according to the present invention.

FIG. 10 shows a structure of a driver 801B having an output line 816 going out both from the first side 801*b* an the vicinity thereof, and the second side 801*a* and the vicinity thereof. The output line 816 extends both to the input side 803*a* and the output side 803*b* of the IC chip 803. Therefore, the output from the amplifier 808 can be output from either of the two sides. This is advantageous for designing the display device so that one of an area including the second side 801*a* and the vicinity thereof, or an area including the first side 801*b* and the vicinity thereof, of the driver 801B is not used for a particular purpose. The driver 801B shown in FIG. 10 is also usable for designing the display device so that the output from the amplifier 808 can be output from both the first side 801*b* and the vicinity thereof, and the second side 801*a* and the vicinity thereof. The driver 801B can raise the degree of design freedom for outputting a non-driving signal generated by the amplifier 808.

Figure 11A:
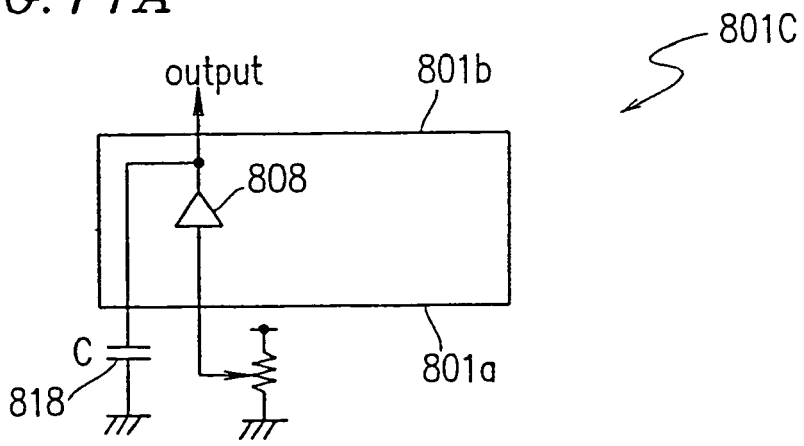
FIGS. 11A through 11C each show a structure of still another driver included in a display device according to the present invention, by which an output of an amplifier can be output from both an input side and an output side of the driver.

FIG. 11A shows a structure of a driver 801C for supplying a non-driving signal generated by the amplifier 808 to a capacitor 818. Provision of the capacitor 818 restricts a peak current. The driver 801C shown in FIG. 11A includes the capacitor 818 on the side of the second side 801*a*.

Figure 11B:
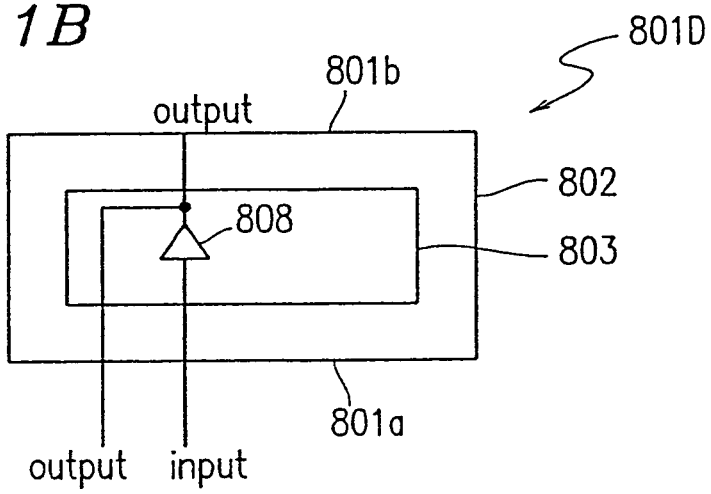

FIG. 11B shows a structure of a driver 801D for allowing an output from the amplifier 808 to be output both from the first side 801*b* and the vicinity thereof, and the second side 801*a* and the vicinity thereof. The output line from the amplifier 808 is branched into two in the IC chip 803.

Figure 11C:
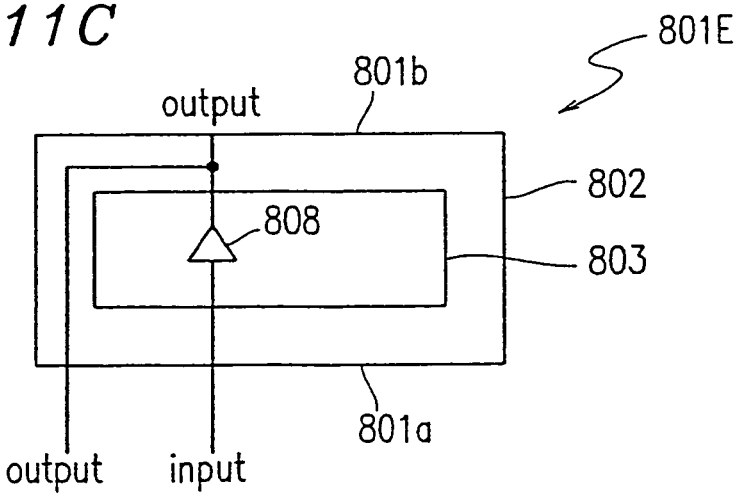

FIG. 11C shows a structure of a driver 801E for allowing an output from the amplifier 808 to be output both from the first side 801*b* and the vicinity thereof, and the second side 801*a* and the vicinity thereof. The output line from the amplifier 808 is branched into two on the insulating substrate 802.

FIGS. 12A through 12D schematically show a structure of a driver including an input line 817 for the amplifier 808, which extends to both the input side 803*a* and the output side 803*b* of the IC chip 803, like the output line 816.

Such a structure of the driver allows a signal to be input to the amplifier 808 both from the input side 803*a* and the output side 803*b* of the IC chip 803. This is advantageous for designing the display-device so that one of an area including the first side 801*b* and the vicinity thereof, or an area including the second side 801*a* and the vicinity thereof, of the driver is not used for a particular purpose.

A signal supplied to the amplifier 808 can take any of the paths represented by arrows 831 through 834 shown in FIGS. 12A through 12D.

Figure 12A:
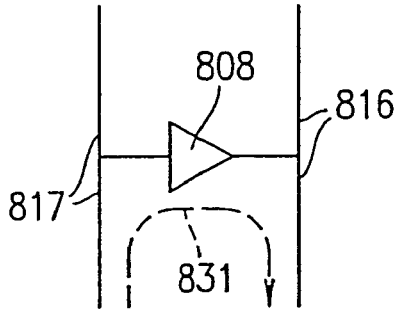
FIG. 12A through 12D show a structure of still another driver included in a display device according to the present invention, by which an input line and an output line of an amplifier extends to an input side and an output side of the driver.

In FIG. 12A, an input signal is input to the amplifier 808 from the input side 803*a*, and a non-driving signal generated by the amplifier 808 is output from the input side 803*a* as represented by arrow 831. This is preferable in the case where, for example, the amplifier 808 is used for generating a gray scale reference signal having a gray scale reference voltage as described below.

Figure 12B:
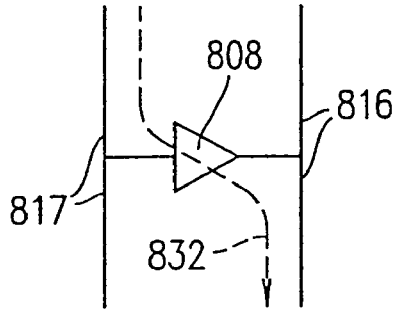

In FIG. 12B, an input signal is input to the amplifier 808 from the output side 803*b*, and a non-driving signal generated by the amplifier 808 is output from the input side 803*a* as represented by arrow 832. This is preferable in the case where, for example, the amplifier 808 is used for detecting a signal in the display panel 20.

Figure 12C:
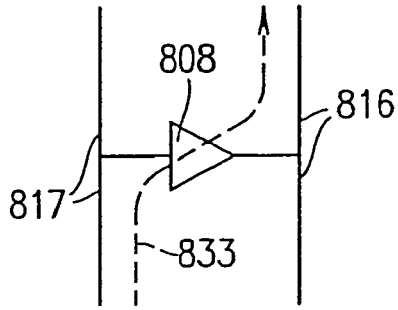

In FIG. 12C, an input signal is input to the amplifier 808 from the input side 803*a*, and a non-driving signal generated by the amplifier 808 is output from the output side 803*b* as represented by arrow 833. This is preferable in the case where, for example, the amplifier 808 is used for generating a common electrode driving signal having a common voltage as described below.

Figure 12D:
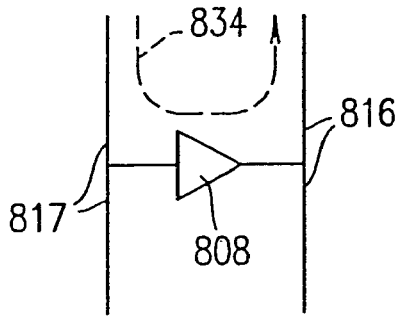

In FIG. 12D, an input signal is input to the amplifier 808 from the output side 803*b*, and a non-driving signal generated by the amplifier 808 is output from the output side 803*b* as represented by arrow 834.

As described above, the driver having such a structure broadens the range of uses of the amplifier 808. The output line 816 for the amplifier 808, which extends both to the input side 803*a* and the output side 803*b*, is usable as a through-line.

Figure 13:
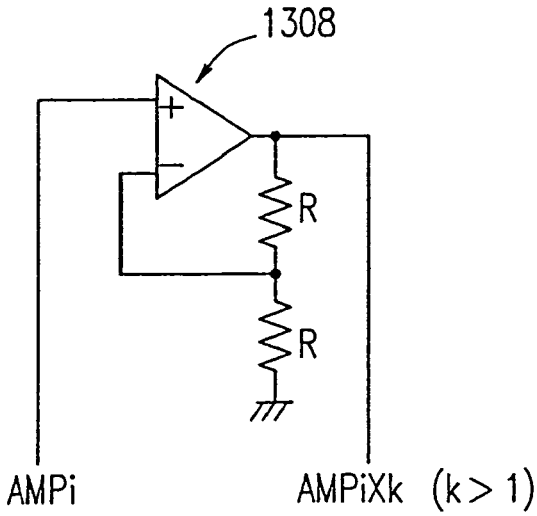
FIG. 13 shows a structure of an amplifier 1308 having a gain greater than 1.

FIG. 13 shows a structure of an amplifier 1308 having a gain greater than 1. Owing to the gain greater than 1, the amplifier 1308 has a broadened range of uses.

The amplifier 1308 generates a non-driving signal having a voltage AMPo based on a voltage AMPi of the input signal. Here, AMPo=AMPi×k (k>1). When a voltage higher than the input voltage is needed, the amplifier 1308 is used. Thus, the range of uses of the amplifier 1308 is broadened. According to the present invention, the gain of the amplifier 1308 is not limited to greater than 1, but may be equal to or less than 1.

In the above description, one driver includes one amplifier 808 for generating a non-driving signal which does not contribute to driving of the bus line section. The present invention is not limited to such a structure of the driver. The driver may include a plurality of amplifiers 808. In this case, more amplifiers can be eliminated from the external component as compared to the conventional art. Thus, the structure of the external component can be further simplified, and the cost thereof can be further reduced.

In the case where one driver includes a plurality of amplifiers 808, the amplifiers 808 may have different arrangements of lines. For example, one of the amplifiers 808 may have the lines arranged as shown in FIG. 8, whereas another of the amplifiers 808 may have the lines arranged as shown in FIG. 10.

Alternatively, the plurality of amplifiers 808 included in one driver may have different uses. For example, one of the amplifiers 808 may be for generating a gray scale reference signal, whereas another of the amplifiers 808 may be for generating a common electrode driving signal.

The driver including one or a plurality of amplifiers 808 is usable as, for example, a signal electrode driver (i.e., a column electrode driving circuit) for a liquid crystal display device. The driver according to the present invention is also usable as a scanning electrode (i.e., a row electrode driving circuit) of a liquid crystal display device. The driver according to the present invention is not limited to being used in a liquid crystal display device, but is also usable for other types of display devices. The term "signal electrode driver" is defined to include a source driver, and the term "scanning electrode driver" is defined to include a gate driver.

The driver according to the present invention may be of a TCP (Tape Carrier Package) type or a COF (Chip On Film) type.

In this example, the driver includes the insulating substrate 802 and the IC chip 803. The driver according to the present invention is not limited to having such a structure. For example, in a display device of a COG mounting system of directly mounting an IC chip on a display panel, the IC chip 803 including the amplifier 808 acts as the driver. In this case, the glass substrate or the plastic substrate, for example, of the display panel acts as the insulating substrate 802.

EXAMPLE 3

A liquid crystal display device according to a third example of the present invention will be described below. Elements having identical functions as those of the elements described in the second example will bear identical reference numerals therewith for convenience.

In the liquid crystal display device in the third example, each of a plurality of drivers 801, used as a plurality of source drivers, includes an amplifier 808 for generating a gray scale reference signal. Therefore, an external component (i.e., a gray scale reference power supply substrate) separated from the display panel and the driver need not have thereon an amplifier for generating a gray scale reference signal, unlike in a conventional display device. This point of the third example will be described below in comparison with the conventional structure.

Figure 14:
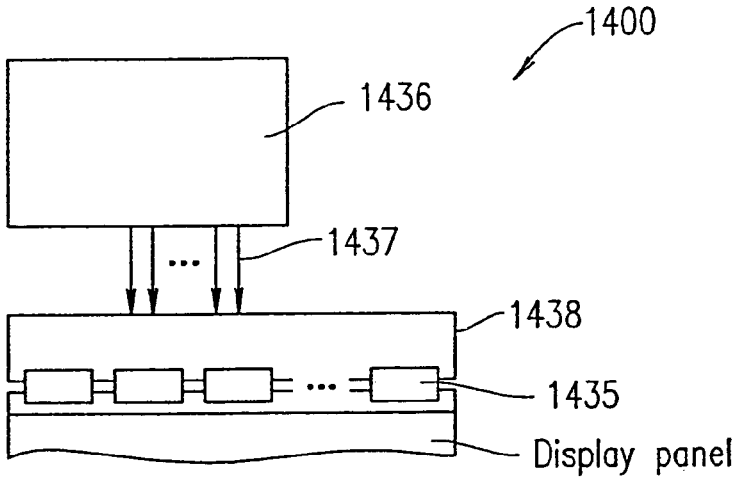
FIG. 14 shows a conventional liquid crystal display device using a gray scale reference voltage generated on a gray scale reference power supply substrate as an external component.

FIG. 14 shows a conventional liquid crystal display device 1400 using a gray scale reference voltage generated by a gray scale reference power supply substrate 1436.

In the case of the conventional liquid crystal display device 1400, a gray scale reference signal having a gray scale reference voltage, which is input to each of the plurality of source drivers 1435, is generated by the gray scale reference-power supply substrate 1436 as an external component. The generated gray scale reference signal is input to each source driver 1435 via a power supply line 1437 and a substrate 1438.

Figure 15:
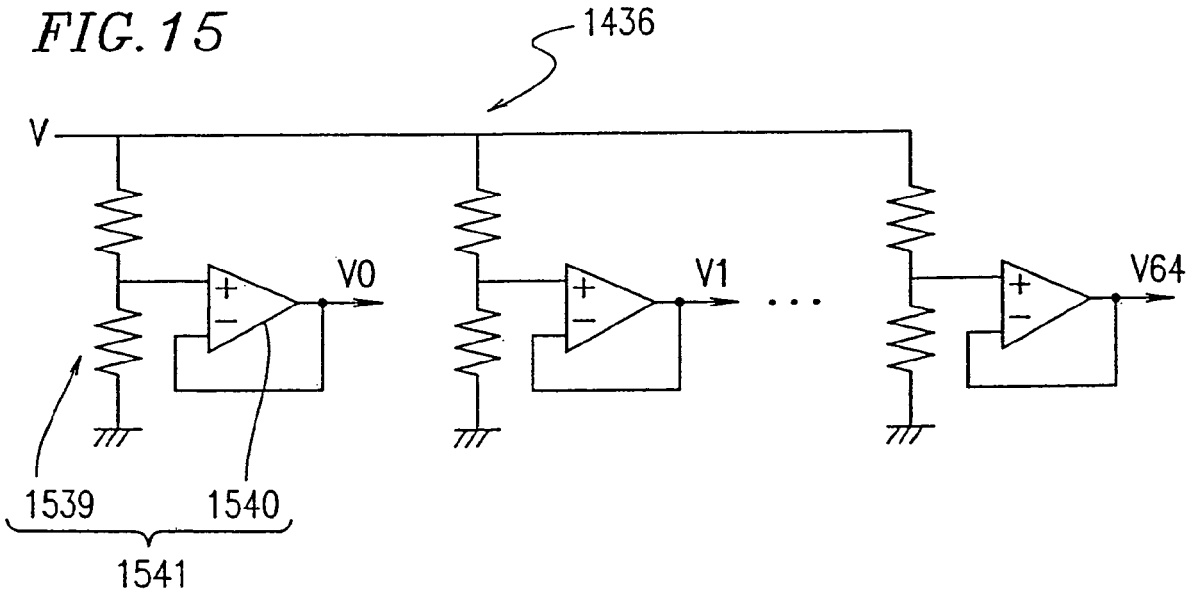
FIG. 15 is a detailed view of the gray scale reference power supply substrate shown in FIG. 14.

FIG. 15 is a detailed view of the configuration of the gray scale reference power supply substrate 1436 in the conventional liquid crystal display device 1400. The gray scale reference power supply substrate 1436 includes units 1541. The number of units 1541 is equal to the number of gray scale reference voltages required. Each unit 1541 includes a resistance voltage dividing circuit 1539 and an amplifier 1540 acting as an operational amplifier. The resistance voltage dividing circuit 1539 includes two resistors. A gray scale reference voltage is generated by amplifying an output from the resistance voltage dividing circuit 1539 by the amplifier 1540.

The conventional liquid crystal display device 1400 has the following problems. The gray scale reference power supply substrate 1436 needs to have a relatively large area on which the elements are to be mounted. This increases the size of, and raises the production cost of, the substrate 1436. In addition, the number of lines for connecting the gray scale reference power supply substrate 1436 and the source drivers 1435 (in the example shown in FIG. 14, the number of the power supply lines 1437) is increased.

Figure 16:
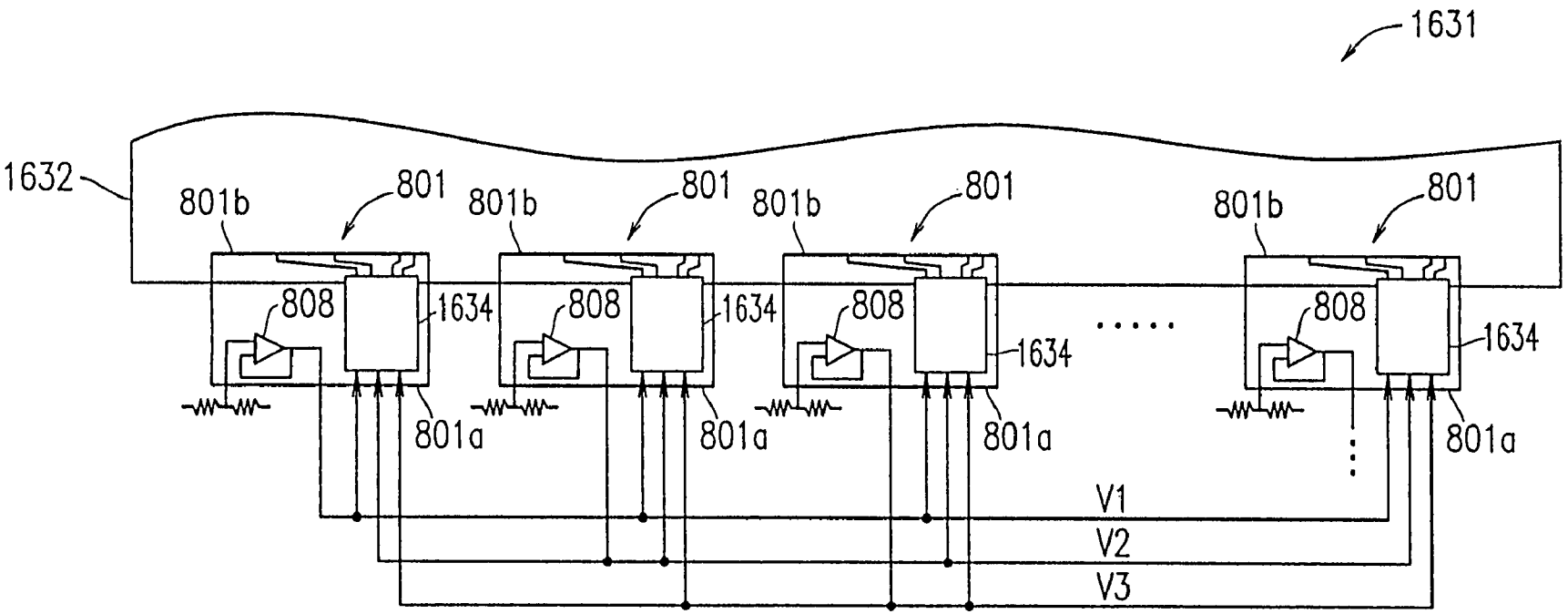
FIG. 16 shows a liquid crystal display device according to still another example of the present invention.

FIG. 16 shows a liquid crystal display device 1631 according to the third example. The liquid crystal display device 1631 includes a plurality of drivers 801 each having an amplifier 808. Each amplifier 808 is used for generating a gray scale reference signal having a gray scale reference voltage. A signal is input to the amplifier 808 from the second side 801*a* of each driver 801 farther from a display panel 1632. A gray scale reference signal generated by the amplifier 808 is output from the second side 801*a* and the vicinity thereof, of each driver 801, facing the display panel 1632. In this specification, a gray scale reference signal is one example of the non-driving signal.

Each driver 801 is used as a source driver (i.e., a column electrode driving circuit). In one embodiment of the invention, the liquid crystal display device 1631 may include about eight to ten source drivers 801. These source drivers 801 are arranged in parallel and connected to the display panel 1632.

The amplifiers 808 included in the respective drivers 801 generate gray scale reference signals having different gray scale reference voltages (V1, V2, V3, . . . ). Each of the generated plurality of gray scale reference signals is input to all resistance dividing circuits 1634 in all the drivers 801.

The resistance dividing circuits 1634 each generate a gray scale signal based on the plurality of gray scale reference signals. Each resistance dividing circuit 1634 acts as a gray scale signal generating section. The gray scale signals generated by the resistance dividing circuits 1634 are used for performing a gray scale display of an image.

Figure 17:
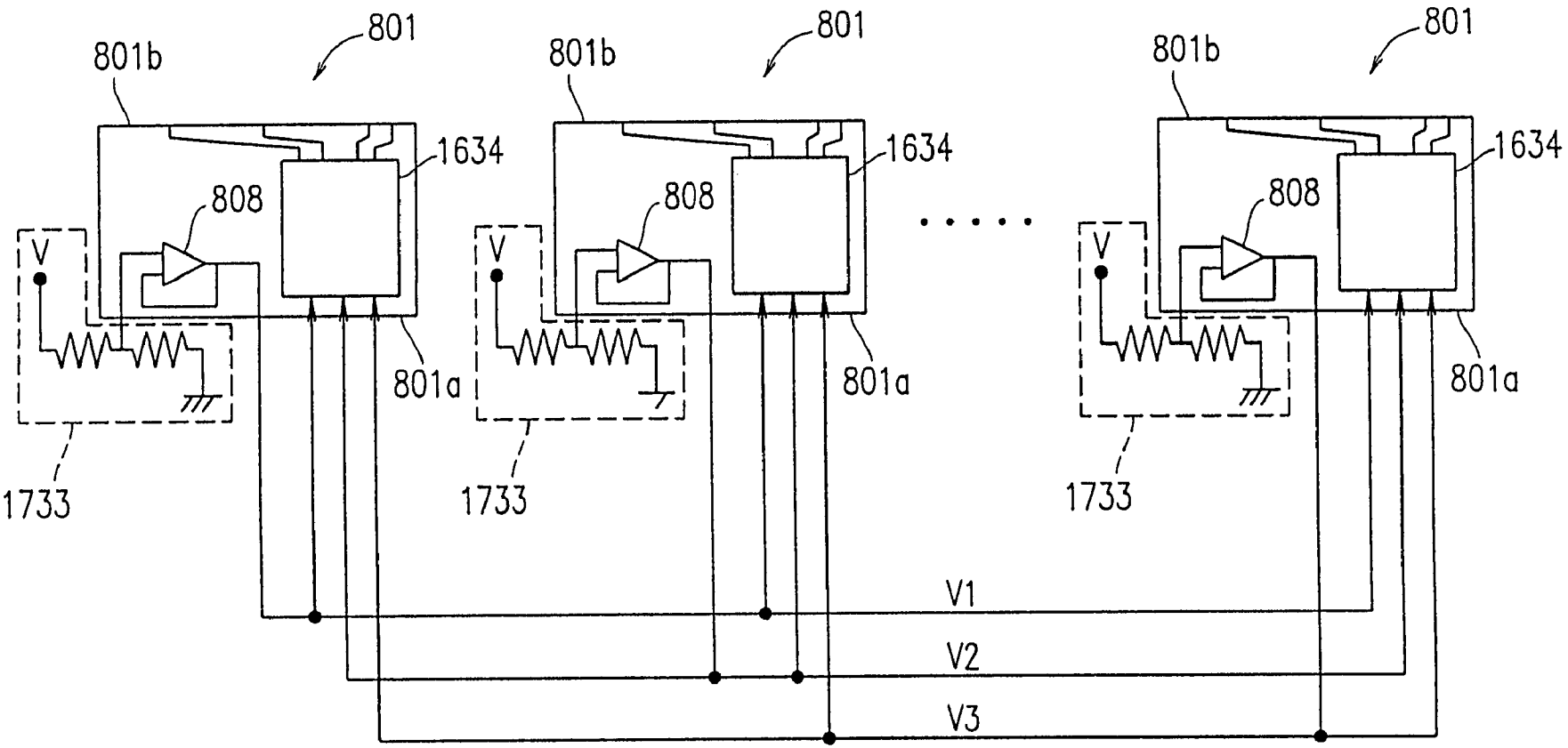
FIG. 17 shows an amplifier and a resistance voltage dividing circuit of a source driver of the liquid crystal display device shown in FIG. 16.

FIG. 17 is an enlarged view of the plurality of drivers 801 of the liquid crystal display device 1631 shown in FIG. 16. As shown in FIG. 17, a signal to be input to each amplifier 808 is generated by a resistance voltage dividing circuit 1733. The resistance voltage dividing circuit 1733 includes two resistors connected in series. One end of the series of the two resistors is connected to a voltage V, and the other end thereof is grounded. To each amplifier 808, a voltage obtained by dividing the voltage V by a different partial resistance from the other resistance is input. Thus, the plurality of amplifiers 808 generate gray scale reference signals having different gray scale reference voltages, and these gray scale reference signals are input to the resistance dividing circuits 1634.

The drivers 801, when used as source drivers for gray scale display, each include a D/A (digital/analog) conversion circuit. When the D/A conversion circuit adopts a resistance division system, each source driver includes a resistance dividing circuit structured in accordance with the number of levels in the gray scale, in order to generate a gray scale voltage based on the gray scale reference voltage input thereto.

Figure 18:
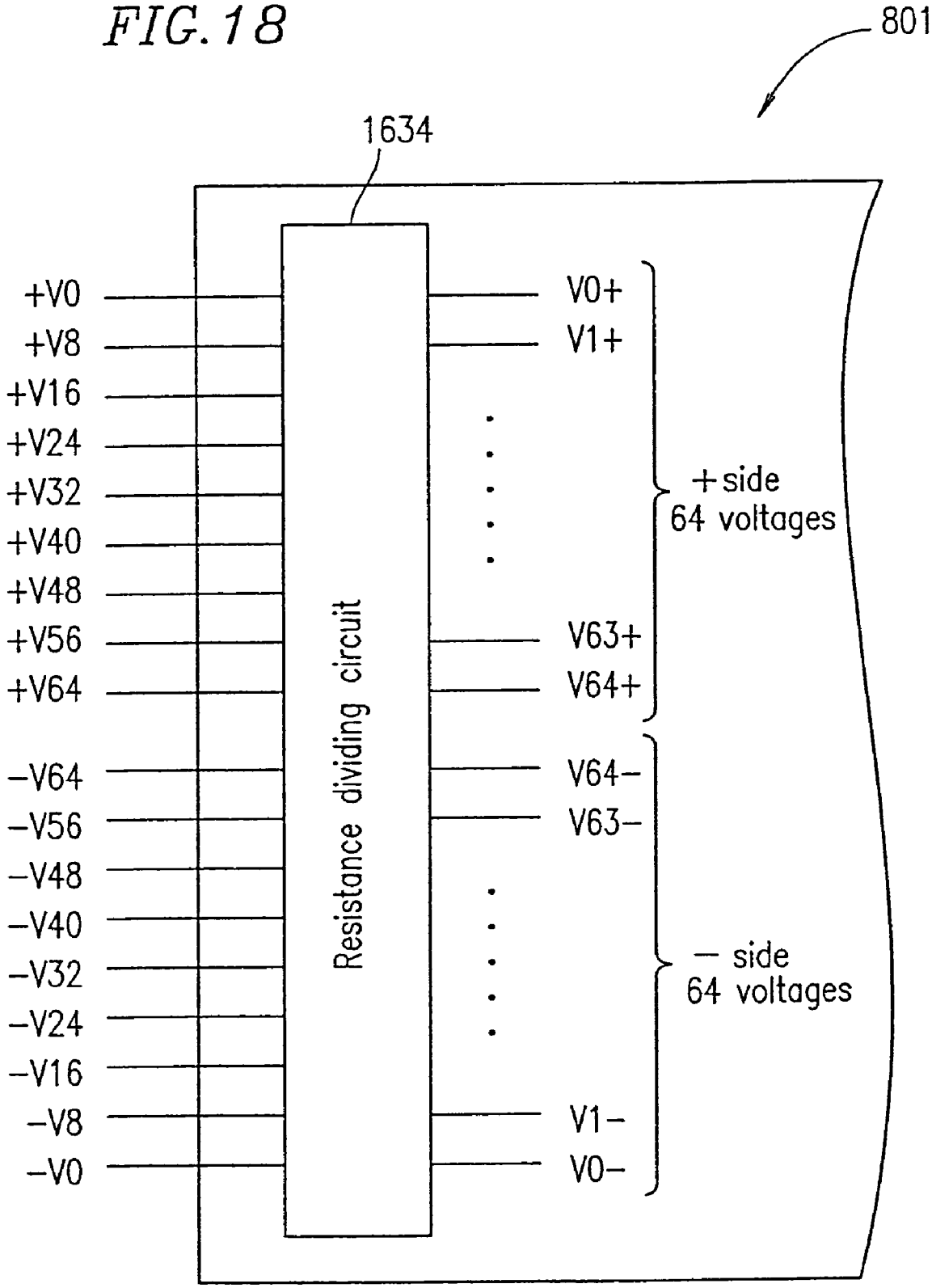
FIG. 18 shows a structure of the source driver including a resistance dividing circuit of the liquid crystal display device shown in FIG. 16.

FIG. 18 is a detailed view of the resistance dividing circuit 1634 when the liquid crystal display device displays images with a 64-level gray scale. The resistance dividing circuit 1634 can generate 64 different gray scale voltages on each of the positive (+) side and the negative (−) side.

An exemplary operation of the resistance dividing circuit 1634 will be described, assuming that, for example, the driver 801 is a source driver of a 6-bit (64-level gray scale) dot inversion system. A gray scale reference signal having 18 gray scale reference voltages (9 voltages on the positive side and 9 voltages on the negative side) is input to the resistance dividing circuit 1634. Here, nine positive voltages of +V0, +V8, +V16, +V24, +V32, +V40, +V48, +V56 and +V64, and nine negative voltages of −V0, −V8, −V16, −V24, −V32, −V40, −V48, −V56 and −V64 are input to the resistance dividing circuit 1634.

Figure 19:
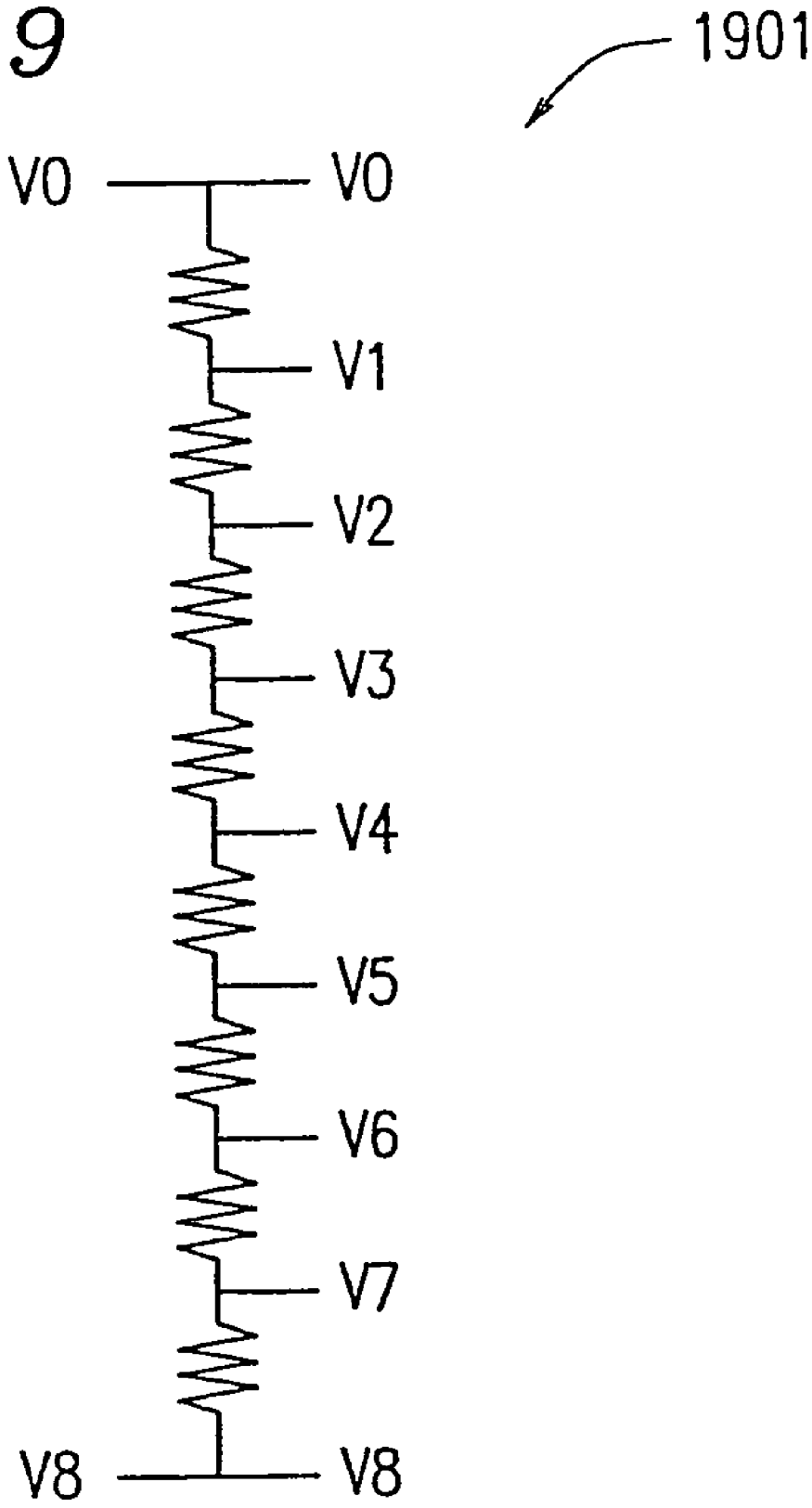
FIG. 19 shows a resistance unit included in the resistance dividing circuit shown in FIG. 18 for dividing the gray scale reference voltage range.

The resistance dividing circuit 1634 includes resistance units 1901. FIG. 19 shows the resistance unit 1901 between the gray scale reference voltage V0 and the gray scale reference voltage V8. The resistance unit 1901 includes eight resistors and divides the range between the gray scale reference voltages V0 and V8 by eight, using a resistance dividing system. Since the resistance dividing circuit 1634 includes eight resistance units 1901 on the positive side and eight resistance units 1901 on the negative side, the resistance dividing circuit 1634 can generate a gray scale signal having 64-level gray scale voltages on the positive side and 64-level gray-scale voltages on the negative side.

The structure of the liquid crystal display device in the third example utilizes that a general display device includes a plurality of source drivers. Each of the source drivers includes one or two amplifiers for generating a gray scale reference signal. Therefore, a sufficient number of amplifiers to generate a required number of gray scale reference signals in the entire display device are provided. Separate signals are input to the amplifiers, and each of the outputs from the amplifiers are connected to all the resistance dividing circuits of the plurality of source drivers. Thus, the gray scale reference power supply substrate as an external component need not include amplifiers for generating a gray scale reference signal. Therefore, the structure of the external component can be simplified and the production cost thereof can be reduced. The number of lines for connecting the external component and the drivers can be reduced. As a result, the display device can be reduced in overall size, thickness and size of the peripheral portion around the display portion.

A general liquid crystal display device includes a plurality of source drivers. Even when each source driver includes a small number of amplifiers, the plurality of amplifiers included in the plurality of source drivers can provide all the required gray scale reference voltages. Furthermore, outputs from all the amplifiers in the plurality of source drivers are input to the driving circuit of each source driver. Therefore, display defects such that, for example, the displayed image has different display characteristics block by block due to non-uniform amplifier characteristics, are prevented from occurring.

In the liquid crystal display device 1631 in the third example, the driver 801 as a source driver includes the amplifier 808 for generating one gray scale reference signal. Even when the amplifiers 808 included in the plurality of drivers 801 cannot generate all the required gray scale reference signals, the number of amplifiers which are required to be mounted on the external component can be reduced. Therefore, the display device can still be reduced in overall size, thickness and size of the peripheral portion around the display portion.

When the liquid crystal display device 1631 includes eight to ten drivers 801 and each driver 801 includes two amplifiers 808, 16 to 20 gray scale reference voltages can be provided. Thus, such a larger number of gray scale reference signals can be provided by the amplifiers 808 included in the drivers 801.

According to the present invention, the number of amplifiers 808 included in each driver 801 is not limited to one or two. Each driver 801 may include three or more amplifiers 808. It is preferable that the number of amplifiers 808 included in each driver 801 is smaller.

The plurality of drivers 801 may include different numbers of amplifiers 808. A part of the plurality of drivers 801 may include one amplifier 801. A part of the plurality of drivers 801 may include no amplifier. From the viewpoint of production cost, however, it is preferable that the plurality of drivers 801 include the same number of amplifiers 808. In the case where it is not necessary to use all the amplifiers 808 for generating a gray scale reference signal, a part of the amplifiers 808 may be used for other purposes.

By providing the two resistors (FIG. 17) in each resistance voltage dividing circuit 1733 in the substrate in the vicinity thereof or in the corresponding driver 801, the structure of the external component can be further simplified.

In the case where the amplifiers 1308 having a gain greater than 1 as shown in FIG. 13 are used, the effect of the present invention is easily provided even when a D/A conversion circuit is used instead of the resistance voltage dividing circuit.

The digital/analog conversion circuit generates an analog voltage for a voltage given in a digital form. When the D/A conversion circuit is used instead of the resistance voltage dividing circuit, an arbitrary voltage can be output without a resistance. In addition, the setting can be programmably variable. However, the gray scale voltage is usually in the range of 0 V to 10 V, whereas the withstand voltage of the D/A conversion circuit is usually up to 5 V. In the case where the amplifier 1308 has a gain greater than 1, for example, 2, a voltage of 10 V can be output when a voltage of 5 V is input. This is effective even when the D/A conversion circuit is used.

Figure 20A:
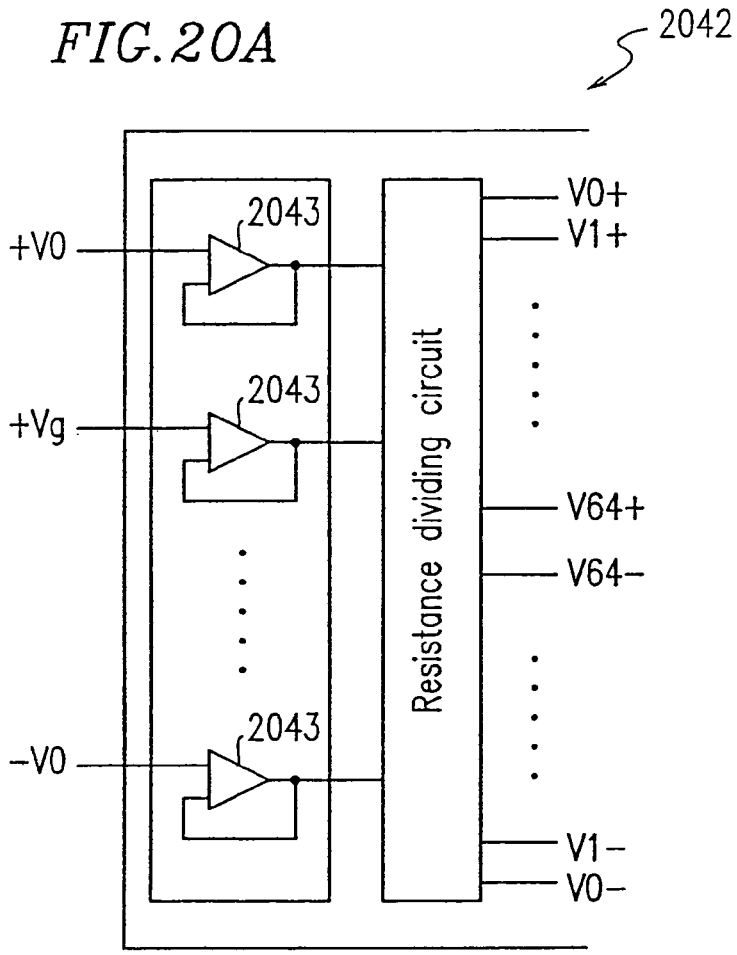
FIG. 20A shows a driver including an equal number of amplifiers to the number of required gray scale reference signals.

It is also conceivable to simply provide an equal number of amplifiers to the number of gray scale reference voltages to be input to an input section of each source driver. Each amplifier generates a gray scale reference signal. FIG. 20A is an enlarged view of one of a plurality of source drivers 2042 included in a display device. The source driver 2042 includes an equal number of amplifiers 2043 to the number of gray scale reference voltages to be input to the source driver 2042.

Figure 20B:
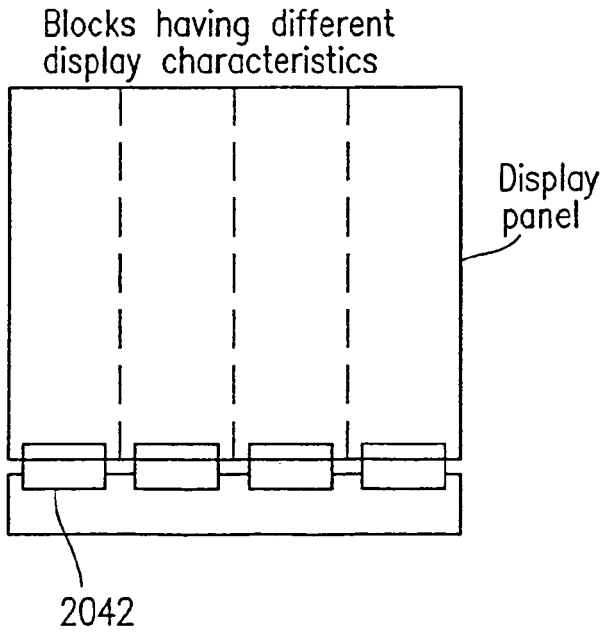
FIG. 20B shows a defective display in which the image has different display characteristics block by block due to non-uniform amplifier characteristics.

In this case, each of the plurality of source drivers 2042 includes a great number of amplifiers 2043, which undesirably requires the area of the IC chip to be increased. When the characteristics (gain and offset) of the amplifiers 2043 are non-uniform among of the drivers 2042, the gray scale display characteristics of the drivers 2042 are slightly different from each other. This undesirably results in non-uniform display. In one example of the non-uniform display, as shown in FIG. 20B, the displayed image is divided into blocks having different display characteristics.

In the liquid crystal display device 1631 in the third example, a gray scale reference signal generated by each amplifier 808 is input to all the drivers 801. This provides the advantages of (1) the number of the required amplifiers 808 is reduced; and (2) the above-described non-uniform display due to the non-uniform amplifier characteristics among the source drivers does not occur.

In the third example, the lines connected to the amplifiers 808 are arranged as shown in FIG. 14, but may be as shown in FIG. 10 or in FIGS. 12A through 12D.

EXAMPLE 4

With reference to FIGS. 21A, 21B, 22A and 22B, a liquid crystal display device according to a fourth example of the present invention will be described. Elements having identical functions as those of the elements described in the second or third example will bear identical reference numerals therewith for convenience.

In the liquid crystal display device in the fourth example, each of a plurality of drivers 801, used as a plurality of source drivers, includes an amplifier 808 for generating a common electrode driving signal. Therefore, an external component separated from the display panel and the driver need not have thereon an amplifier for generating a common electrode driving signal, unlike in a conventional display device. This point of the third example will be described below in comparison with the conventional structure.

Figure 21A:
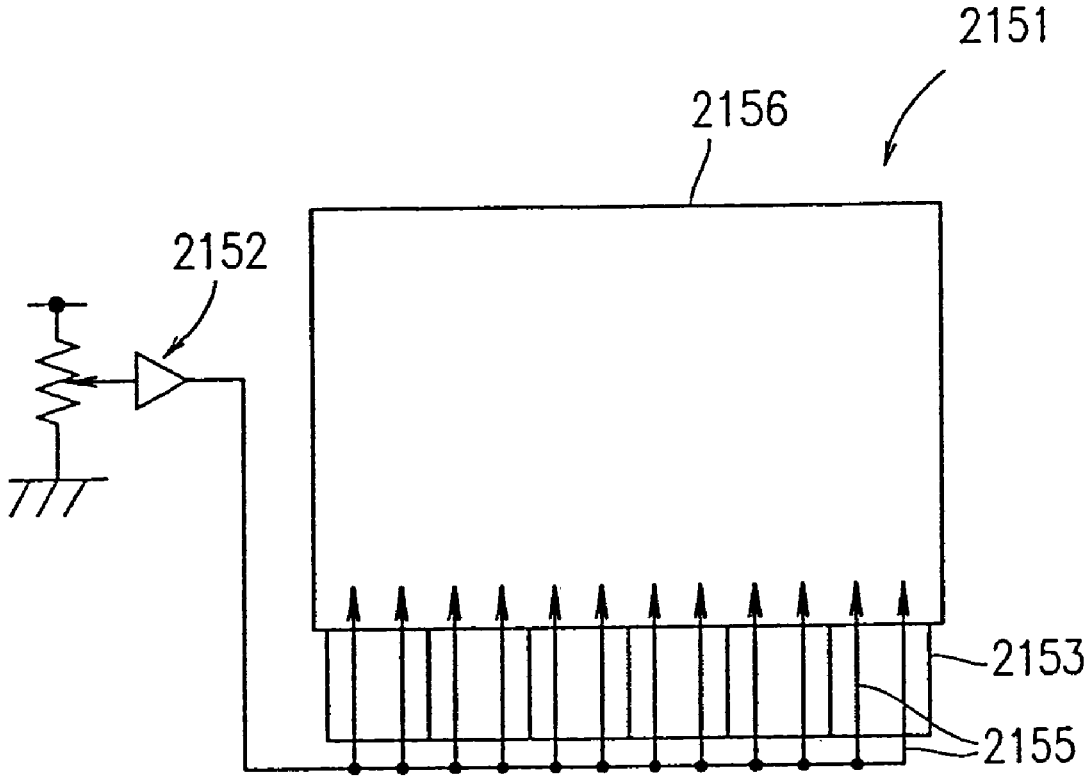
FIG. 21A shows a conventional liquid crystal display device.

FIG. 21A shows a conventional liquid crystal display device 2151. FIG. 21A shows a structure of the liquid crystal display device 2151 for outputting a common electrode driving signal having a common voltage to a common electrode. As shown in FIG. 21A, the conventional liquid crystal display device 2151 includes an amplifier 2152 for generating a common electrode driving signal having a common voltage provided in a common electrode driving circuit on an external component.

Figure 21B:
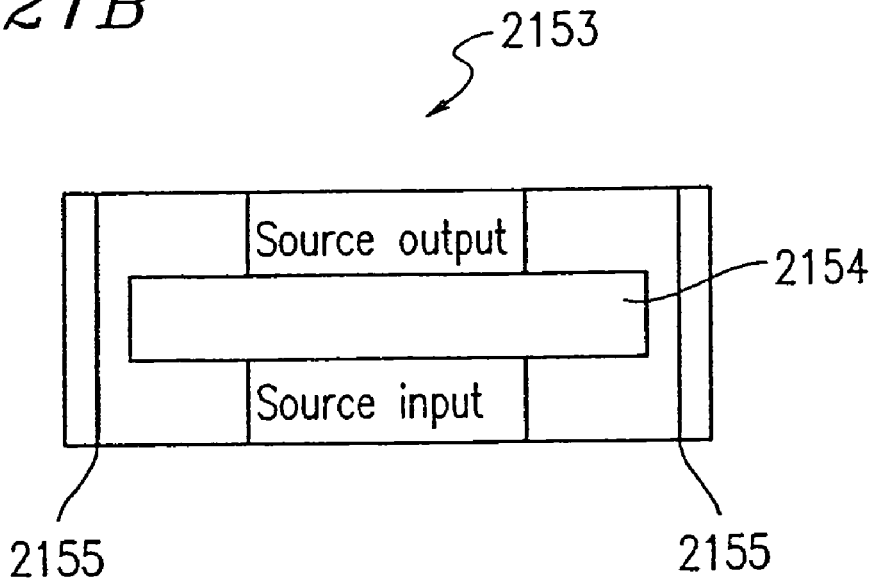
FIG. 21B is a detailed view of a source driver included in the conventional liquid crystal display device shown in FIG. 21A.

FIG. 21B shows a detailed view of the source driver 2153 included in the conventional liquid crystal display device 2151. The source driver 2153 includes an IC chip 2154 and common electrode driving signal lines 2155 so as to interpose the IC chip 2154. The common electrode driving signal lines 2155 directly connect an input and an output of the source driver 2153. The source driver 2153 sends a common electrode driving signal generated by the amplifier 2152, provided on the external component, to the display panel 2156 (FIG. 21A) via the common electrode driving signal lines 2155.

Figure 22A:
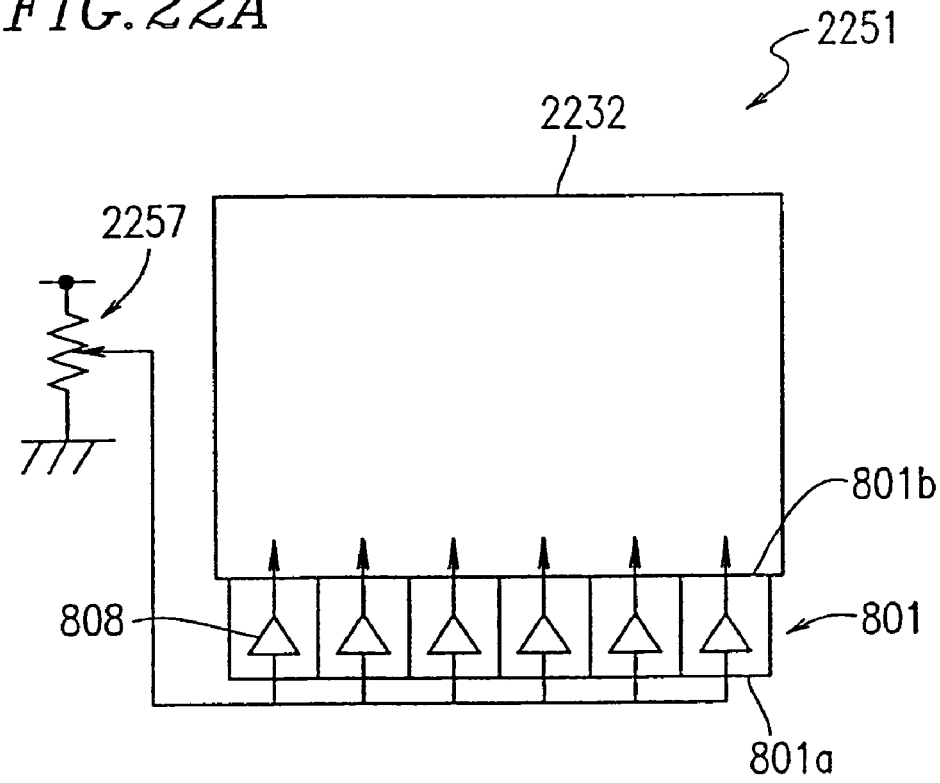
FIG. 22A shows a liquid crystal display device according to still another example of the present invention.

FIG. 22A shows a liquid crystal display device 2251 in the fourth example according to the present invention. FIG. 22A shows a structure of the liquid crystal display device 2251 for outputting a common electrode driving signal having a common voltage to a common electrode. The liquid crystal display device 2251 includes a plurality of drivers 801, and each driver 801 includes an amplifier 808. The amplifier 808 generates a common electrode driving signal based on a signal which is input thereto from the second side 801*a* of the driver 801 via a resistor 2257. As described above, the second side 801*a* is farther from a display panel 2232 than the other surface of the driver 801. The generated common electrode driving signal is output from the first side 801*b* and the vicinity thereof, which faces the display panel 2232. The common electrode driving signal is one example of the non-driving signal.

Each driver 801 is used as a source driver. The liquid crystal display device 2251 shown in FIG. 22A includes six source drivers 801. The drivers 801 are arranged in parallel and connected to the display panel 2232.

Figure 22B:
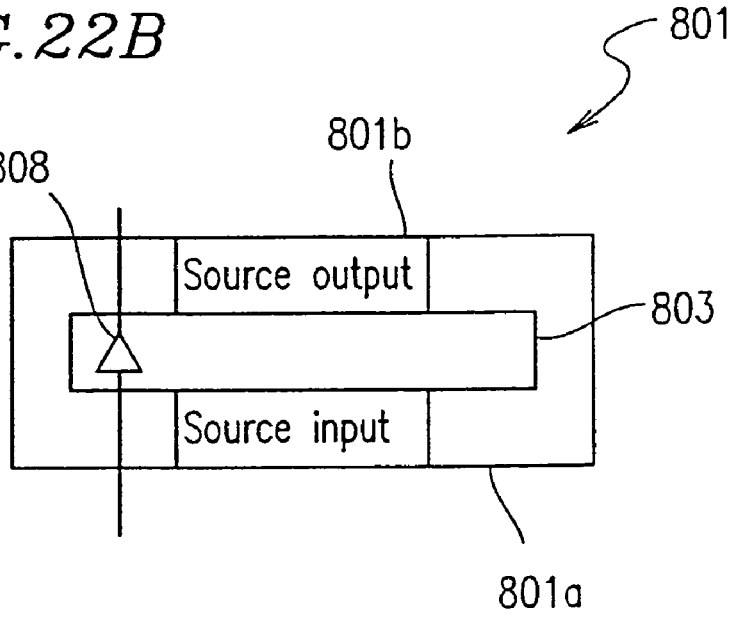
FIG. 22B is a detailed view of a source driver included in the liquid crystal display device shown in FIG. 22A.

FIG. 22B shows a detailed view of the source driver 801 included in the liquid crystal display device 2251.

The amplifier 808 for generating a common electrode driving signal may be provided on a gate driver. One driver 801 preferably includes a plurality of amplifiers 808 but may include one amplifier 808. It is not necessary that all the plurality of source drivers 801 include an amplifier 808 for generating a common electrode driving signal. A part of the plurality of source drivers 801 may include such an amplifier 808. A common voltage of the common electrode driving signal is applied to a common electrode which is provided on one of two substrates of the display panel 2232.

In a liquid crystal display device of a dot inversion driving system, a common voltage of a common electrode driving signal is a DC voltage having a substantially median level in the range of voltages of outputs from the source drivers. The amplifiers for generating a common electrode driving signal are DC current amplification circuits.

In the fourth example of the present invention, as shown in FIG. 22A, each driver 801 of the liquid crystal display device 2251 includes an amplifier 808 (i.e., a DC current amplification circuit) for generating a common electrode driving signal. Therefore, the amplifier 2152 which is provided on an external substrate in the conventional liquid crystal display device 2151 can be eliminated from the external substrate.

Since each driver 801 includes the amplifier 808 of the liquid crystal display device 2251, the required driving capability for generating a common voltage of the liquid crystal display device 2251 can be provided by the plurality of amplifiers 808, and thus the size of the amplifier 808 of each driver 801 can be reduced. For example, when ten source drivers 801 are used, the driving capability required for each amplifier 808 (i.e., each buffer amplifier) can be as small as 1/10th of the driving capability required for the amplifier 2152 conventionally provided on the external component.

In the fourth example, the lines connected to the amplifiers 808 are arranged as shown in FIG. 22A, but may be as shown in FIG. 10 or in FIGS. 12A through 12D.

The liquid crystal display device 2251 may be structured so that the common electrode driving signal generated by the amplifier 808 can be output from both the first side 801*b* and the vicinity thereof, and the second side 801*a* and the vicinity thereof. This can be realized, as shown in FIG. 11B, by branching the output line from the amplifier 808 in the IC chip 803, or, as shown in FIG. 1C, by branching the output line from the amplifier 808 on the insulating substrate 802. Additionally, as shown in FIG. 1A, by connecting the capacitor 818 to the output of the amplifier 808, the peak current can be restricted.

The resistor 2257 (FIG. 22A) in the common electrode driving circuit may be provided on a substrate in the vicinity of each driver 801 or in the corresponding driver 801. This further simplifies the external component.

A display device according to the present invention is sufficiently compact and can be produced easily and at low cost despite a plurality of column electrode driving circuits and a plurality of row electrode driving circuits included therein.

In one aspect of the invention, a display device includes a display panel including a bus line section; and at least one driver for driving the bus line section included in the display panel. Each of the at least one driver includes an amplifier for generating a non-driving signal based on an input signal, the non-driving signal not contributing to driving of the bus line section.

Owing to such a structure, unlike the conventional liquid crystal display device, it is not necessary to provide an amplifier for generating a non-driving signal (e.g., a gray scale reference signal or a common electrode driving signal) on an external component which is separate from the display panel and the driver. Therefore, the structure of the external component is simplified, and the production cost thereof is reduced.

The above-described structure also prevents defective connection between the external component and the driver, thus increasing the production yield. Since the structure of the external component is simplified, the display device itself can be reduced in overall size, thickness and size of the peripheral portion around the display portion.

In one embodiment of the invention, each of the at least one driver includes a first surface facing the display panel, and the first surface includes a first side in contact with the display panel and a second side facing the first side. Each of the at least one driver includes an input section, provided closer to the second side than the first side, through which the input signal is input, and an output section, closer to the second side than the first side, through which the non-driving signal is output.

An amplifier included in such a display device is preferably usable for generating a gray scale reference signal.

In one embodiment of the invention, each of the at least one driver includes a first surface facing the display panel, and the first surface includes a first side in contact with the display panel and a second side facing the first side. Each of the at least one driver includes an input section, provided closer to the second side than the first side, through which the input signal is input, and at least one output section, provided in at least one of a position closer to the second side than the first side and a position closer to the first side than the second side, through which the non-driving signal is output.

Such a structure increases the degree of design freedom for outputting a non-driving signal generated by the amplifier.

In an embodiment of the invention, the amplifier amplifies the input signal at a gain greater than 1 so as to generate the non-driving signal.

This structure is usable even in the case where the non-driving signal needs to have a voltage higher than the input voltage.

In another aspect of the invention, a display device includes a display panel for providing a gray scale display by a gray scale voltage; and at least one driver for generating a gray scale signal having the gray scale voltage. Each of the at least one driver includes an amplifier for generating a gray scale reference signal having a gray scale reference voltage based on an input signal, and a gray scale signal generation section for generating a gray scale signal having the gray scale voltage based on the gray scale reference voltage.

Owing to such a structure, unlike the conventional liquid crystal display device, it is not necessary to provide an amplifier for generating a gray scale reference signal on an external component which is separate from the display panel and the driver. Therefore, the structure of the external component is simplified, and the production cost thereof is reduced. In addition, since the number of lines for connecting the external component and the driver can be reduced, the display device itself can be reduced in overall size, thickness and size of the peripheral portion around the display portion.

In one embodiment of the invention, each of the at least one driver includes a first surface facing the display panel, and the first surface includes a first side in contact with the display panel and a second side facing the first side. Each of the at least one driver includes an input section, provided closer to the second side than the first side, through which the input signal is input, and an output section, provided closer to the second side than the first side, through which the gray scale reference signal is output.

An amplifier included in such a display device is preferably usable for generating a gray scale reference signal.

In one embodiment of the invention, each of the at least one driver includes a first surface facing the display panel, and the first surface includes a first side in contact with the display panel and a second side facing the first side. Each of the at least one driver includes an input section, provided closer to the second side than the first side, through which the input signal is input, and at least one output section, provided in at least one of a position closer to the second side than the first side and a position closer to the first side than the second side, through which the gray scale reference signal is output.

Such a structure increases the degree of design freedom for outputting a gray scale reference signal generated by the amplifier.

In an embodiment of the invention, the amplifier amplifies the input signal at a gain greater than 1 so as to generate the gray scale reference signal.

Even when a D/A conversion circuit is used for generating a gray scale reference voltage, a desired range of gray scale voltages can be provided.

In an embodiment of the invention, the at least one driver are a plurality of drivers, each of the plurality of drivers includes one or two amplifiers, and a plurality of gray scale reference signals generated by the amplifiers included in the plurality of drivers have different gray scale reference voltages from each other, and each of the plurality of gray scale reference signals is input to each of the plurality of drivers.

Owing to such a structure, the number of amplifiers included in each of the plurality of drivers is reduced, while all or most of required gray scale reference signals can be generated by the amplifiers included in the drivers. In addition, since all the outputs from the amplifiers are input to each of the drivers, the display defect such that the displayed image has different display characteristics block by block due to non-uniform amplifier characteristics, do not occur.

In still another aspect of the invention, a display device includes a display panel including two substrates, one of which has a common electrode provided thereon; and at least one driver for outputting a common electrode driving signal for driving the common electrode. Each of the at least one driver includes at least one amplifier for generating the common electrode driving signal based on an input signal.

Owing to such a structure, it is not necessary to provide an amplifier for generating a common electrode driving signal on an external component which is separate from the display panel and the driver. Therefore, the structure of the external component is simplified, and the production cost thereof is reduced.

In one embodiment of the invention, each of the at least one driver includes a first surface facing the display panel, and the first surface includes a first side in contact with the display panel and a second side facing the first side. Each of the at least one driver includes an input section, provided closer to the second side than the first side, through which the input signal is input, and at least one output section provided in at least one of a position closer to the second side than the first side and a position closer to the first side than the second side.

Such a structure increases the degree of design freedom for outputting a common electrode driving signal generated by the amplifier.

In an embodiment of the invention, the at least one driver are a plurality of drivers, and each of the plurality of drivers includes one amplifier.

Owing to such a structure, the required driving capability can be provided by the plurality of amplifiers. Thus, the size of the amplifier for generating a common electrode driving signal in each driver (buffer amplifier size) can be reduced.

In still another aspect of the invention, a driver, for driving a display panel including a bus line section, includes an amplifier for generating a non-driving signal based on an input signal, the non-driving signal not contributing to driving of the bus line-section.

A driver having such a structure eliminates the necessity of providing an amplifier for generating a non-driving signal (e.g., a gray scale reference signal or a common electrode driving signal) on an external component which is separate from the display panel and the driver. Therefore, the structure of the external component is simplified, and the production cost thereof is reduced.

The above-described structure also prevents defective connection between the external component and the driver, thus increasing the production yield. Since the structure of the external component is simplified, the display device itself can be reduced in overall size, thickness and size of the peripheral portion around the display portion.

In one embodiment of the invention, the driver further includes a first surface facing the display panel, the first surface including a first side in contact with the display panel and a second side facing the first side; and an input section, provided closer to the second side than the first side, through which the input signal is input, and an output section, provided closer to the second side than the first side, through which the non-driving signal is output.

An amplifier included in such a driver is preferably usable for generating a gray scale reference signal.

In one embodiment of the invention, the driver further includes a first surface facing the display panel, the first surface including a first side in contact with the display panel and a second side facing the first side; and an input section, provided closer to the second side than the first side, through which the input signal is input, and at least one output section, provided in at least one of a position closer to the second side than the first side and a position closer to the first side than the second side, through which the non-driving signal is output.

Such a structure increases the degree of design freedom for outputting a non-driving signal generated by the amplifier.

In an embodiment of the invention, the amplifier amplifies the input signal at a gain greater than 1 so as to generate the non-driving signal.

This structure is usable even in the case where the non-driving signal needs to have a voltage higher than the input voltage.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A display device, comprising:

a display panel for providing a gray scale display by a gray scale voltage; and at least one driver for generating a gray scale signal having the gray scale voltage, wherein each of the at least one driver includes an amplifier for generating a gray scale reference signal having a gray scale reference voltage based on an input signal, and a gray scale signal generation section for generating a gray scale signal having the gray scale voltage based on the gray scale reference voltage.

2. A display device according to claim 1, wherein:

each of the at least one driver includes a first surface facing the display panel, and the first surface includes a first side in contact with the display panel and a second side facing the first side, and each of the at least one driver includes an input section, provided closer to the second side than the first side, through which the input signal is input, and an output section, provided closer to the second side than the first side, through which the gray scale reference signal is output.

3. A display device according to claim 1, wherein:

each of the at least one driver includes a first surface facing the display panel, and the first surface includes a first side in contact with the display panel and a second side facing the first side, and each of the at least one driver includes an input section, provided closer to the second side than the first side, through which the input signal is input, and at least one output section, provided in at least one of a position closer to the second side than the first side and a position closer to the first side than the second side, through which the gray scale reference signal is output.

4. A display device according to claim 1, wherein the amplifier amplifies the input signal at a gain greater than I so as to generate the gray scale reference signal.

5. A display device according to claim 1, wherein:

the at least one driver are a plurality of drivers, each of the plurality of drivers includes one or two amplifiers, and a plurality of gray scale reference signals generated by the amplifiers included in the plurality of drivers have different gray scale reference voltages from each other, and each of the plurality of gray scale reference signals is input to each of the plurality of drivers.

6. A display device as in claim 1, wherein each of the at least one driver includes a first surface facing the display panel, and the first surface includes a first side in contact with the display panel and a second side facing the first side.

7. A display device, comprising:

a display panel including two substrates, one of which has a common electrode provided thereon;

and at least one driver for outputting a common electrode driving signal for driving the common electrode, wherein each of the at least one driver includes at least one amplifier for generating the common electrode driving signal based on an input signal.

8. A display device according to claim 7, wherein:

each of the at least one driver includes a first surface facing the display panel, and the first surface includes a first side in contact with the display panel and a second side facing the first side, and each of the at least one driver includes an input section, provided closer to the second side than the first side, through which the input signal is input, and at least one output section provided in at least one of a position closer to the second side than the first side and a position closer to the first side than the second side.

9. A display device according to claim 7, wherein: the at least one driver are a plurality of drivers, and each of the plurality of drivers includes one amplifier.

* * * * *

UNITED STATES PATENT AND TRADEMARK OFFICE

CERTIFICATE OF CORRECTION

PATENT NO. : 7,719,506 B2
APPLICATION NO. : 11/398939
DATED : May 18, 2010
INVENTOR(S) : Taketoshi Nakano et al.

It is certified that error appears in the above-identified patent and that said Letters Patent is hereby corrected as shown below:

On the Title page of the patent, please add:

(73) Assignee: SHARP KABUSHIKI KAISHA, Osaka (JP)

Signed and Sealed this
Fifth Day of June, 2012

David J. Kappos

David J. Kappos
*Director of the United States Patent and Trademark Office*